United States Patent [19]

Gentile

[11] 4,316,569

[45] Feb. 23, 1982

[54] OSCILLATING CAM FEED APPARATUS FOR A PRESS

[75] Inventor: Joseph P. Gentile, Pittsburgh, Pa.

[73] Assignee: Vamco Machine and Tool, Inc., Pittsburgh, Pa.

[21] Appl. No.: 182,463

[22] Filed: Aug. 28, 1980

Related U.S. Application Data

[63] Continuation-in-part of Ser. No. 112,066, Jan. 14, 1980, abandoned.

[51] Int. Cl.[3] ..... B65H 17/36

[52] U.S. Cl. ..... 226/158; 74/384; 100/257

[58] Field of Search ..... 226/142, 158, 159, 139, 226/141, 180; 74/384; 269/203, 205; 100/257

[56] References Cited

U.S. PATENT DOCUMENTS

| | | | |
|---|---|---|---|
| 3,638,846 | 2/1972 | Wiig | 226/142 |
| 3,758,011 | 9/1973 | Portmann | 226/142 |
| 3,784,075 | 1/1974 | Portmann | 226/142 |
| 3,805,931 | 4/1974 | Portmann | 192/18 A |
| 3,977,589 | 8/1979 | Gentile | 226/180 |
| 3,998,498 | 12/1976 | Portman | 308/3 A |
| 4,133,216 | 1/1979 | Gentile et al. | 74/384 |
| 4,138,913 | 2/1979 | Gentile | 83/236 |
| 4,156,387 | 5/1979 | Portmann | 100/257 |

*Primary Examiner*—Leonard D. Christian

*Attorney, Agent, or Firm*—Stanley J. Price, Jr.; John M. Adams

[57] ABSTRACT

An input shaft of a press feed is rotated at a preselected speed and is drivingly connected to a cam that rotates with the input shaft. Continuous rotation of the cam is converted to oscillating rotational movement of a cam follower through a preselected angle of rotation. The cam follower is nonrotatably connected to an output shaft that is connected by an adjustable linkage mechanism through a pair of meshing gears to a driven feed roll. The oscillating rotational movement of the output shaft is transmitted to the driven feed roll to advance the driven feed roll in contact with stock material through a preselected degree of rotation corresponding to a preselected feed length of the stock material to the press. The feed length is adjustable by changing the length of travel of the linkage mechanism with respect to the degree of rotation of the output shaft. The driven feed roll rotates through a preselected angle in a first direction to feed a selected material, remains stationary during a first dwell period, is released from the material and rotates in the opposite direction back to the initial feed position, remains stationary for a second dwell period, and engages the material for another feed cycle. The intermittent feeding operation is coordinated with the operations of feed roll release and stock material clamping.

30 Claims, 13 Drawing Figures

OSCILLATING CAM FEED APPARATUS FOR A PRESS

CROSS REFERENCE TO RELATED APPLICATION

This application is a continuation-in-part of prior application Ser. No. 112,066 filed Jan. 14, 1980, now abandoned.

BACKGROUND OF THE INVENTION

1. Field of the Invention

This invention relates to apparatus for feeding stock material intermittently to a press and more particularly to apparatus for generating intermittent feeding of the stock material by oscillating rotational movement of a driven feed roll through a preselected angle of rotation.

2. Description of the Prior Art

It is the conventional practice in high speed automatic press operations to feed a strip of stock material from a coil to the dies of the press for punching, stamping, cutting or the like at a preselected length of the stock material. The stock material must be fed from the coil in timed relation with the press operation so that before the dies contact the stock material, the stock material is moved into a final position by the die pilots as the feed rolls are released from engagement with the stock material. The stock material is then stationarily positioned between the dies. After the press operation is completed the feed rolls are actuated to advance another length of the stock material to the press. Therefore, the feeding of the stock material to the press must be coordinated with each press operation so that prior to each operation a new segment of stock material is in position relative to the dies for the press.

U.S. Pat. Nos. 4,133,216 and 4,138,913 are examples of one type feeding apparatus for power punch presses in which the feed rolls are drivingly connected by a plurality of meshing gears to an input shaft drivingly connected to the punch press crankshaft. A gear cammed drive receives continuous, uniform rotation from the input shaft and converts the rotation to a non-continuous step-by-step, intermittent rotational movement to the driven feed roll. With this arrangement the feed rolls advance intermittently through a 360° rotational cycle. During the dwell periods of the rotational cycle the driven feed roll is not rotated and the punching operation is carried out. After the punching operation is completed, the feed rolls are again incrementally advanced so that another preselected length of stock material is passed beneath the press.

U.S. Pat. Nos. 3,758,011 and 3,784,075 are examples of another type of incremental feed apparatus that converts continuous rotation of a drive shaft to contrarotating oscillating movement of the feed rolls. The drive shaft is connected through a pair of meshing gears one of which is arranged eccentrically and is connected to a lever that is rotated to-and-fro. The pivotal movement of the lever is transmitted to a shaft that is, in turn, coupled to the feed rolls. The oscillatory movement of the lever and shaft is transmitted to the feed rolls to generate a to-and-fro movement. The feed length can be changed by altering the amplitude of the oscillatory movement of the feed rolls.

Synchronously with the to-and-fro movement of the feed rolls, the feed rolls move toward one another into a feed position and move away from one another into an idling position. The movement of the feed rolls between the feed and idling positions takes place at the point where the feed rolls change directions of oscillation. A holding mechanism for the workpiece is actuated when the feed rolls move from their feed position into the idling position and is deactuated when the rollers move from their idling position into the feed position.

There is need for press feeding apparatus that incrementally feeds the workpiece to the press by oscillatory movement of a feed roll generated by the rotation of the press crankshaft in an arrangement that permits precise adjustments to be made in the feed length. While it has been suggested to oscillate the feed rolls of a press feed to incrementally feed the workpiece to the press, the prior art feeding apparatus require a complex arrangement for interconnecting the operations of feeding, clamping, and releasing the feed rolls the requires many component parts which necessitate increased maintenance and replacement of worn parts.

SUMMARY OF THE INVENTION

In accordance with the present invention there is provided apparatus for intermittently feeding a workpiece that includes an input shaft supported for rotation at a continuous preselected speed. An output shaft has a first end portion and a second end portion. Cam drive means drivingly connects the output shaft first end portion to the input shaft for generating oscillating rotation movement of the output shaft through a fixed preselected angle of rotation. Feed means intermittently feeds a preselected length of the workpiece in a selected direction. A linkage is drivingly connected at one end to the output shaft second end portion and at another end to the feed means. The linkage is operable to transmit the oscillating rotational movement of the output shaft to the feed means and oscillate the feed means through a preselected, variable angle of rotation. The feed means is actuated by the oscillating rotational movement of the linkage to intermittently advance a preselected length of the workpiece corresponding to the angle of rotation of the feed means.

The cam drive means includes a cam nonrotatably connected to the input shaft. A cam follower rides on the cam surface of the cam and is nonrotatably connected to the first end portion of the output shaft. The cam continuously rotates with the input shaft and oscillating rotational movement of the cam follower through a preselected angular path, for example through a 60° arc. Thus, upon one complete rotation of the cam, the cam follower is rotated in a first direction through a preselected angle and is then rotated in the opposite direction back through the same preselected angle to the original starting position. At the end of each angle of rotation of the cam follower, the cam follower experiences a dwell period. During the dwell period there is no transmission of rotation from the cam to the cam follower.

The angular movement of the cam follower in a first direction generates rotational movement of the feed means, which preferably includes a feed roll and an idler roll where either roll may be driven or both rolls simultaneously driven, to linearly advance the workpiece a preselected distance. After a preselected length of the workpiece is fed, the driven feed roll is released from engagement with the workpiece to permit final positioning of the workpiece in the press by the pilots of the press dies. A clamp is thereafter engaged and the driven feed roll is released during a first dwell period so that rotational movement of the cam follower in the opposite direction returns the driven feed roll to the initial feed position for repeating the intermittent feeding of the work piece.

During the interval in which the driven feed roll is rotated back to the initial feed position, the workpiece is engaged by a clamping mechanism that is operated synchronously with the feeding of the workpiece and is also driven by the input shaft. A second dwell period precedes rotation of the driven feed roll to advance the workpiece. During the second dwell period the rolls are returned to engagement with the workpiece and the material clamp is released.

The linkage for the oscillating cam feed includes an arm member nonrotatably secured to the second end of the output shaft. The arm member includes a longitudinally extending recess slidably receiving a slide block that is threadedly connected to an adjusting screw. The slide block is connected to one end of a drive link, and the drive link is connected at the opposite end to the driven feed roll. In one embodiment the drive link is connected to the driven feed roll through a gear train that includes a pair of gears or a plurality of gears. In a second embodiment the drive link is connected directly to the feed roll.

The adjusting screw is rotatably supported on the arm member. By rotation of the adjusting screw, the slide block is longitudinally movable on the slide portion to a preselected position on the arm member. Thus, the length of travel of the drive link can be adjusted by moving the slide block to a preselected position on the arm member to provide a preselected angular displacement of the driven feed roll and, in turn, to provide a preselected feed length for a fixed angular rotation of the cam follower and output shaft.

Synchronously with the intermittent feeding of the workpiece, the driven feed roll is moved into and out of feeding engagement with the workpiece, and a clamping mechanism is moved into and out of clamping engagement with the workpiece during the dwell cycle. Thus, during the interval in which the driven feed roll is rotated back to its starting position to feed the next length of the workpiece, the driven feed roll is released from engagement with the workpiece, and the clamping mechanism is moved into engagement with the workpiece.

The feed roll releasing and the workpiece clamping mechanisms are actuated by a pair of cams that are connected to the input shaft in a preselected angular position by an adjustable connection. The idler feed roll is connected by a second linkage to a follower that rides on the surface of one of the cams. The clamping mechanism is also connected through a linkage to a follower that engages the surface of the second cam. Thus upon rotation of the input shaft the pair of cams are continuously rotated to actuate the idler feed roll to move into and out of engagement with the workpiece synchronously with the movement of the clamping mechanism into and out of clamping engagement with the workpiece.

During the intermittent feeding of the workpiece the driven and idler feed rolls engage the workpiece and rotation of the driven feed roll by oscillation of the feed cam forwardly advances a selected length of the workpiece. After the selected length of the workpiece is fed and during the first dwell period of the feed cam, the idler feed roll is released from engagement with the workpiece. The position of the workpiece in the press is finally adjusted by the die pilots. The clamping mechanism is then actuated to engage the workpiece. As the feed cam is oscillated in the opposite direction to return the driven feed roll to its initial position for feeding, the driven and idler feed rolls are removed from feeding engagement with the workpiece. During this interval the workpiece is maintained secured by the clamping mechanism. During the second dwell period of the feed cam, the driven and idler feed rolls are first returned to feeding engagement with the workpiece followed by the steps of releasing the clamping mechanism from engagement with the workpiece.

Accordingly, the principal object of the present invention is to provide apparatus for intermittently feeding a workpiece by oscillating rotational movement of a driven feed roll through a preselected angle of rotation corresponding to a selected feed length.

Another object of the present invention is to provide a cam feed for intermittently feeding a selected length of a workpiece to a power actuated press in which the length of feed of the workpiece for each press operation is adjustable by controlling the degree of angular movement of a driven feed roll.

Another object of the present invention is to provide intermittent feeding of a workpiece to a press by a cam feed operated synchronously with the operations of releasing a driven feed roll from engagement with the workpiece and clamping the workpiece in position when the driven feed roll is released.

These and other objects of the present invention will be more completely disclosed and described in the following specification, the accompanying drawings, and the appended claims.

DESCRIPTION OF THE PREFERRED EMBODIMENT

Figure 1:
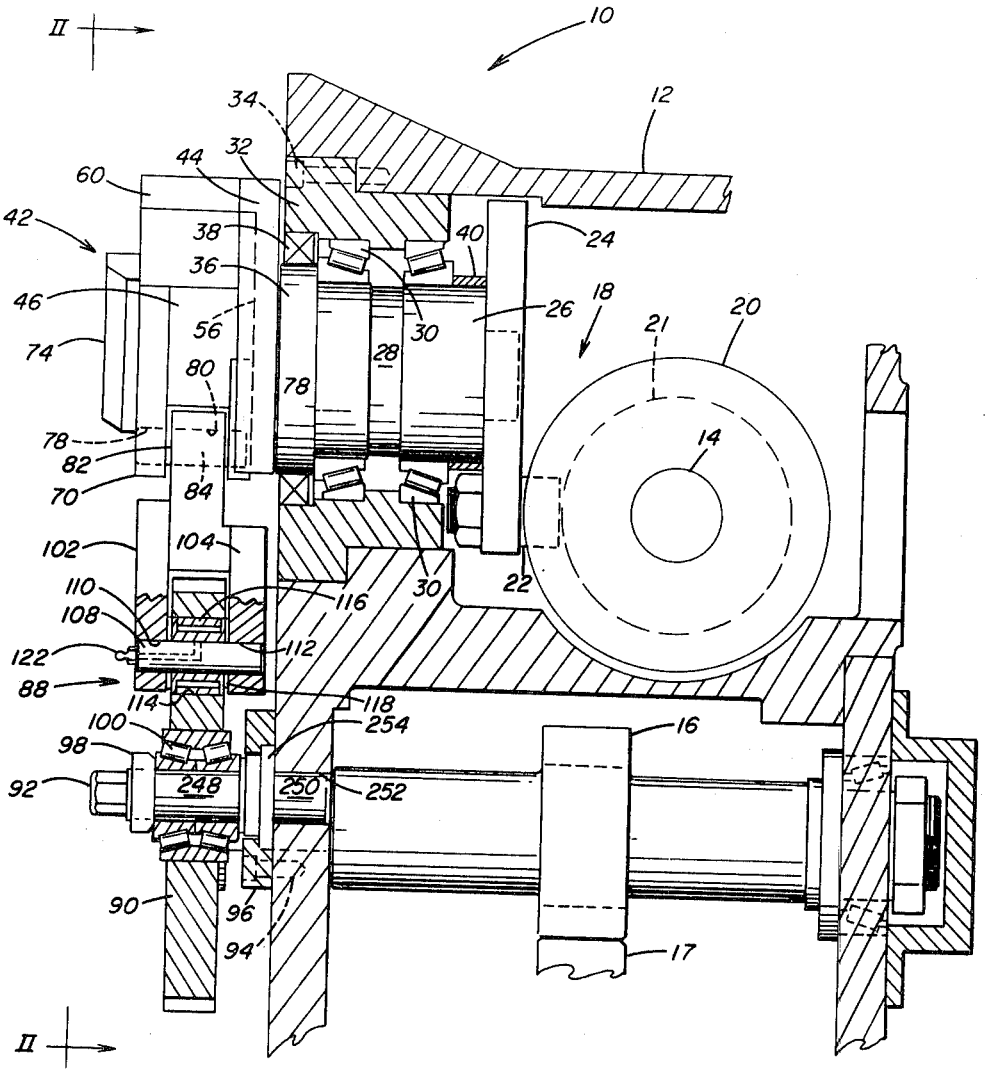
FIG. 1 is a partial sectional fragmentary view in side elevation of a first embodiment of the cam feed apparatus for drivingly connecting an input shaft to a feed roll to generate a preselected degree of rotation of the feed roll for a selected feed length of a workpiece.
Figure 2:
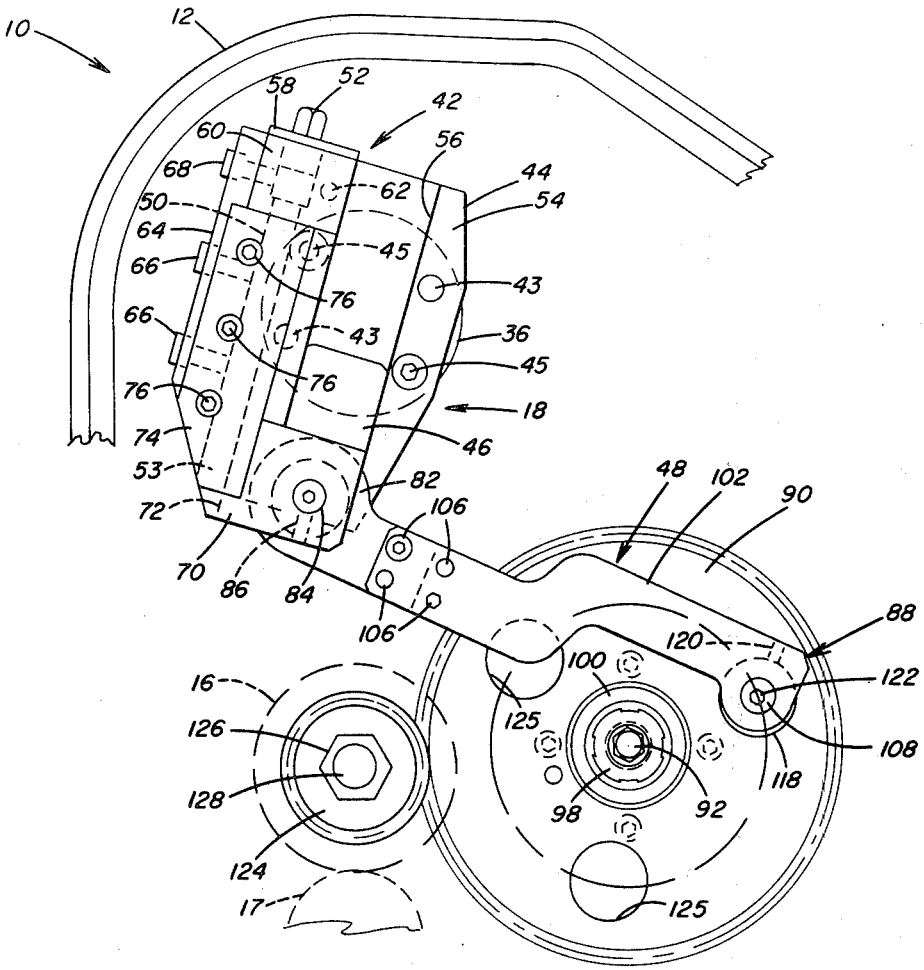
FIG. 2 is a fragmentary view taken along line II—II of FIG. 1, illustrating a linkage assembly that generates oscillating rotational movement of the feed roll through a preselected angle of rotation.

Referring to the drawings and particularly to FIGS. 1 and 2 there is illustrated a first embodiment of apparatus generally designated by the numeral 10 for feeding a workpiece such as continuous stock material from a reel to a power operated press, as for example a press for stamping, punching, cutting or the like of a preselected length of material from the workpiece. The apparatus 10 includes a suitable housing 12 and an input shaft 14, illustrated in greater detail in FIG. 3. The input shaft 14 extends through the housing 12 and is supported for rotation therein. The input shaft 14 is drivingly connected to the crankshaft (not shown) of the press in a manner as illustrated in U.S. Pat. No. 4,138,913. Rotation of the crankshaft is transmitted to the input shaft 14 to rotate the input shaft at a continuous preselected speed.

Figure 3:
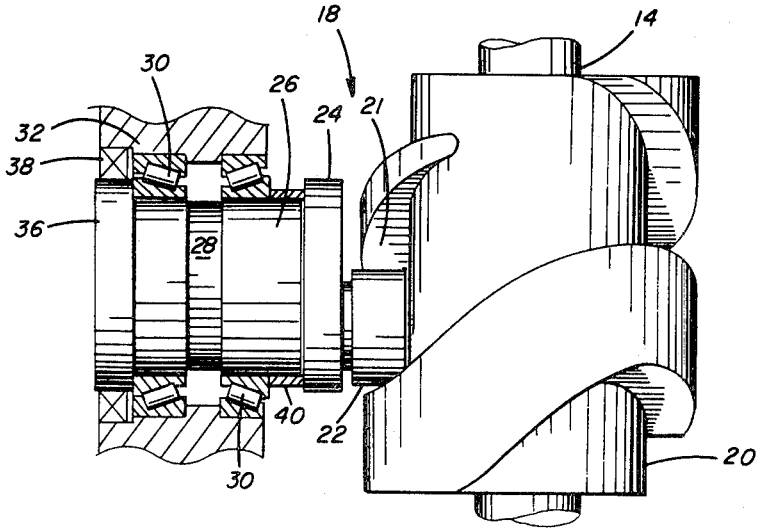
FIG. 3 is a fragmentary, plan view partially in section of the cam drive connection of the feed press input shaft to an output shaft for driving the feed roll shown in FIG. 1, illustrating a right angle connection of the input shaft to the output shaft.

In accordance with the present invention continuous rotation of the input shaft 14 is transmitted by a cam feed mechanism generally designated by the numeral 18 in FIGS. 1, 2 and 3 to a driven feed roll 16. The driven feed roll 16 and an idler roll 17 are operable, as will be explained later in greater detail, to advance a preselected length of the stock material at a preselected speed to a press where the stock material is desirably treated, that is punched, stamped, cut or the like. The driven feed roll 16 and the idler roll 17 are positioned in overlying relation with the stock material caught between the feed and idler rolls. The rotary motion of the input shaft 14 is converted by the cam feed mechanism 18 to generate noncontinuous, intermittent, oscillating rotation of the driven feed roll 16 through a preselected degree of rotation to intermittently feed a preselected length of the stock material to the press.

Figure 8:
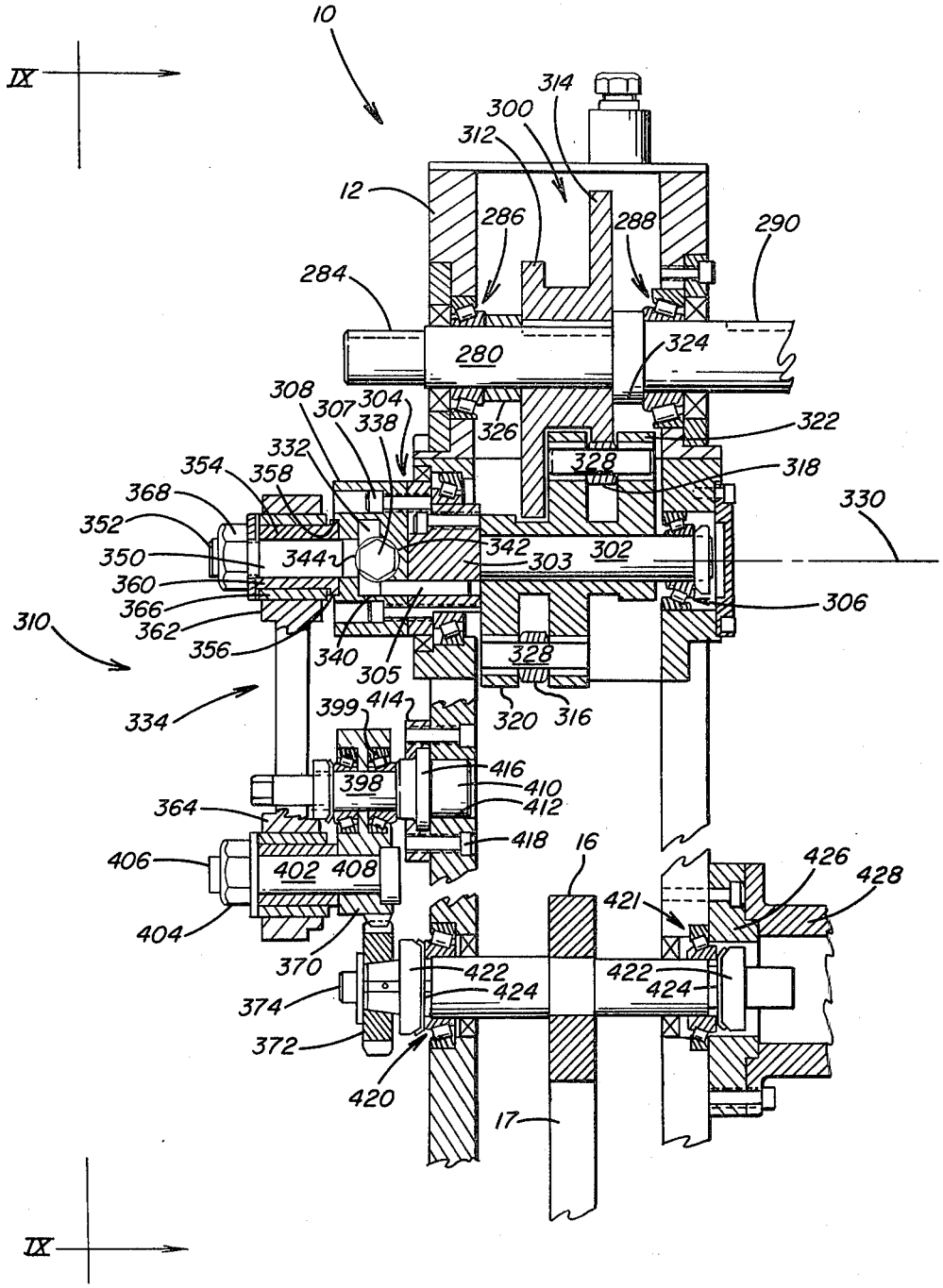
FIG. 8 is a developed partial sectional view in side elevation of a second embodiment of the cam feed apparatus, illustrating the input and output shafts positioned in parallel relation.

The cam feed mechanism generally designated by the numeral 18 is operable to effect a change in the rate of linear feed of the stock material to the press and/or to change the length of feed of the stock material to the press. The cam feed mechanism 18 includes, in part, a cam 20 drivingly connected to the input shaft 14 to rotate continuously at the rate of rotation of the input shaft 14. The cam 20 includes a cam track 21 that is arranged to receive a cam follower 22 that is secured adjacent to the periphery of a circular cam plate 24. The cam plate 24 is axially and nonrotatably secured to a first end 26 of an output shaft 28 that is rotatably supported by bearings 30 in a bearing housing 32. The output shaft 28, as seen in FIG. 3, is positioned perpendicular or at a right angle to the input shaft 14. An arrangement for positioning the shafts 28 and 14 in parallel relation is illustrated in FIG. 8 and will be described hereinafter in greater detail.

The bearing housing 32 is secured to the housing 12 by bolts 34. The output shaft 28 includes a second end 36. A suitable oil seal 38 is positioned between the output shaft second end 36 and the bearing housing 32 to seal the bearings 30. At the opposite end 26 of the output shaft 28, a spacer 40 is positioned between the bearings 30 and the cam plate 24 to preload the bearings 30.

With this arrangement uniform continuous rotation of the cam 20 is converted by movement of the cam follower 22 in the cam track 21 of the cam 20 to oscillating rotational movement of the cam plate 24 through a preselected angle of rotation. As for example, as the cam follower 22 follows the cam track 21 of the cam 20 during one revolution of the cam 20, the cam plate 24 rotates from an initial position through an angle of 60°. The cam plate 24 stops during a first dwell period of rotation of the cam 20 and then resumes rotation in the opposite direction through an angle of 60°. The cam plate 24 is returned to its initial starting position and is stopped during a second dwell period of rotation of the cam 20. This is a modified sine curve-type cam feed which compensates for the inertia of the moving stock material by accelerating the stock from an initial rest position to a maximum feed rate and then decelerating the stock from the maximum feed rate to the rest position.

The oscillation of the cam plate 24 from an initial position through a preselected angle and then back through the same angle to the initial position occurs in one complete revolution of the cam 20. By continuously rotating the cam 20 the cam plate 24 is continuously oscillated back and forth through a preselected angle of rotation. At the end of each angle of rotation the cam plate 24 experiences a dwell period in which the plate 24 does not move.

The oscillating movement of the cam plate 24 is transmitted by the output shaft 28 to a linkage assembly generally designated by the numeral 42. The linkage assembly 42 includes, in part, a transfer arm 44 that is nonrotatably connected to the output shaft second end 36 by dowel pins 43 and cap screws 45. The transfer arm 44 slidably supports a slide block 46 that is connected to a drive link generally designated by the numeral 48. As illustrated in FIGS. 1 and 2 the transfer arm 44 is suitably connected to the output shaft 28 in a manner where the intersection of the transverse and longitudinal axes of the transfer arm 44 is coaxially aligned with the axis of rotation of the output shaft 28.

The transfer arm 44 has an elongated body portion 54 with a longitudinal recessed portion 56. The slide block 46 is longitudinally movable in the recessed portion 56. The slide block 46 is movable in the recessed portion 56 by rotation of an adjusting screw 50, shown in FIG. 2, having end portions 52 and 53. End portion 52 extends through aligned bores of a cover plate 58 and an end block 60. Cover plate 58 is suitably secured to end block 60, and end block 60 is secured to transfer arm 44 by threaded member 62. A backplate 64 is connected by threaded members 66 to the transfer arm 44. The end block 60 is stationarily connected to backplate 64 by threaded member 68.

The slide block 46 includes a two part or bifurcated end 70 having a bore 72 through one part and arranged to threadedly receive the adjusting screw end portion 53. A clamp bar 74 abuts the backplate 64 and is positioned in overlying spaced relation with the adjusting screw 50. The clamp bar 74 is, in turn, connected by threaded members 76 to the backplate 64.

By rotation of the adjusting screw end portion 52 the slide block end portion 70 is advanced longitudinally on the adjusting screw 50 to move the slide block 46 to a preselected position in the recessed portion 56. In this manner, the slide block end portion 70 is moved to a preselected position relative to the rotational axis of the output shaft 28. The slide block 46 is accordingly movable by releasing the clamp bar 74 from frictional engagement with the surface of slide block end portion 70. The slide block 46 is retained in a preselected position on the transfer arm 44 by securing the clamp bar 74 in frictional contact with the surface of the slide block end portion 70. Thus, by selectively positioning the slide block end portion 70 on the adjusting screw 50 a preselected distance from the axis of rotation of the output shaft 28, it is possible to adjust the length of travel of the linkage assembly 42 to provide a preselected degree of rotation of the driven feed roll 16 and accordingly provide a preselected feed length for a fixed angular rotation of the output shaft 28.

The slide block bifurcated end portion 70 includes a transverse bore 78 shown in FIG. 1, that is aligned with a bore 80 in end portion 82 of drive link 48. A clevis pin 84 extends through the aligned bores 78 and 80. A set screw 86 (FIG. 2) extends through end portion 70 to engage a flat of clevis pin 84 to prevent pin 84 from rotating in a bearing (not shown) retained in bore 80. In this manner the drive link 48 is connected to the slide block 46. An opposite end 88 of the drive link 48 is eccentrically connected adjacent to the periphery of an enlarged gear 90. The enlarged gear 90 is rotatably mounted on a gear shaft 92 that is secured to the housing 12 by a cap screw 94 extending through a clamp ring 96 into the housing 12. A bearing nut 98 threadedly engages the gear shaft 92 to retain the gear 90 on the gear shaft 92, and a bearing assembly 100 rotatably supports the gear 90 on the gear shaft 92.

As illustrated in FIG. 1 the drive link end portion 88 is formed by a pair of parallel spaced arm members 102 and 104 which are connected by suitable fasteners 106 (FIG. 2) to the drive link end portion 82. The arm members 102 and 104 are connected to the gear 90 by a clevis pin 108 extending through a pair of bores 110 and 112 aligned with an aperture 114 in the gear 90. The clevis pin 108 extends through a roller bearing assembly 116 retained in the aperture 114 of the gear 90. The arm members 102 and 104 are spaced from the roller bearing assembly 116 by a thrust bearing 118. The clevis pin 108 is retained in the aligned bores 110 and 112 and roller bearing assembly 116 by a set screw 120 (FIG. 2) that extends through arm member 102 into contact with the clevis pin 108. The clevis pin 108 is also provided with a grease fitting 122 for supplying lubricant to the area around the clevis pin 108 in the roller bearing assembly 116.

The enlarged gear 90 includes a plurality of apertures 125 in addition to aperture 114 that are positioned at a preselected radial distance from the axis of rotation of the gear shaft 92. The drive link 48 may also be connected to the enlarged gear 90 by extending the clevis pin 108 through a preselected one of the apertures 125. In this manner different portions of the gear 90 are placed in mesh with the drive gear 124 of the feed roll 16 so as to prevent accelerated wear of one segment of the gear 90 and permit wear of the gear teeth to be uniformly distributed around the entire gear 90.

The enlarged gear 90 is positioned in meshing relation with a reduced gear 124. The reduced gear 124 is nonrotatably connected by a nut 126 to the threaded end of a shaft 128 extending axially from the driven feed roll 16. The driven feed roll 16 is suitably supported for rotation in the housing 12. The oscillating angular movement of the output shaft 28 is thus transmitted by the drive link 48 to the enlarged gear 90. Therefore, for a given fixed angle of oscilltion of the output shaft 28, the enlarged gear 90 will also oscillate through a preselected angle of rotation as determined by the longitudinal position of the slide block 46 on the transfer arm 44 and the length of travel of the drive link 48. By adjusting the position of the slide block 46, the length of travel of the drive link 48 is adjustable. In this manner it is possible to provide for a variation in the angular movement of the driven feed roll 16 and a change in the feed length.

Figure 7:
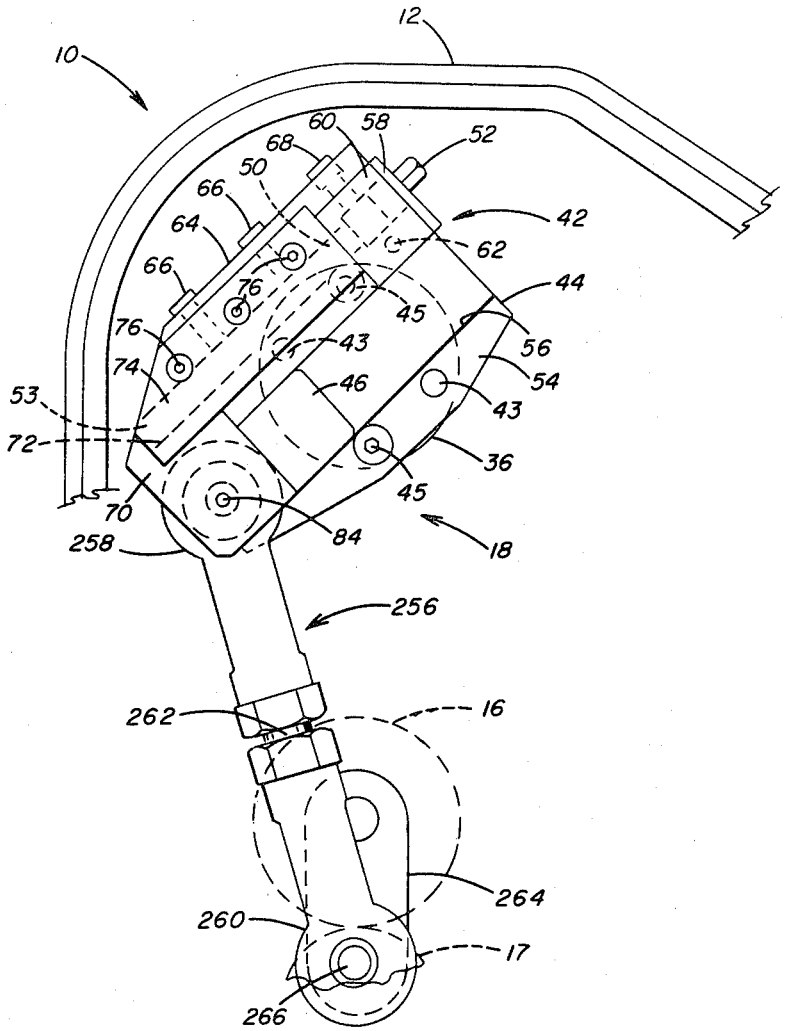
FIG. 7 is a view similar to FIG. 2, illustrating another arrangement for connecting a linkage assembly to the feed roll.

The driven feed roll 16 cooperates with idler roll 17 to feed the stock material, for example, to the dies of the punch press. The idler roll 17 is operable to periodically move away from the driven feed roll 16 and permit the driven feed roll 16 to oscillate back to its initial position for feeding the stock material during the punching operation. The idler roll 17 then moves back toward the driven feed roll 16 in order to permit the next increment of the stock material to be fed to the dies of the punch press. The idler roll 17 is fixed to a rotatable shaft (not shown) in a manner as disclosed in U.S. Pat. No. 3,977,589, which is incorporated herein by reference. The rotatable shaft is journaled within a frame which is rotated about an axis to move the idler roll 17 toward and away from the driven feed roll 16. The rotatable shaft and frame will not be described in detail for the present invention.

Where desired the linkage assembly 42 may be connected to the driven feed roll 16, as illustrated in FIG. 7 and to be discussed later in greater detail, and the gear train coprising gears 90 and 124 deleted. However, by utilizing the meshing gears 90 and 124 to transmit the oscillating rotational movement to the driven feed roll 16, it is possible to rotate the driven feed roll 16 through an angle greater than the angle of rotation of the output shaft 28. This permits an increase in the feed length over a feed length which would result from rotating the driven feed roll 16 through an angle corresponding to the angle of rotation of the output shaft 28. Accordingly, the gear ratio used will also determine the feed length.

Adjustments in the feed length are easily made by changing the length of travel of the drive link 48 or by adding additional gears to the gear train connecting the drive link 48 to the feed roll 16. The length of travel of the drive link 48 is adjusted by changing the distance between the axis of rotation of output shaft 28 and the connection of the drive link 48 to the transfer arm 44. By moving this connection toward the axis of rotation of output shaft 28, the angular displacement of the driven feed roll 16 is decreased. Accordingly, the feed length is decreased. Thus, with this arrangement very accurate adjustments can be quickly made in the feed length without the time consuming operation of changing feed rolls of different diameters.

Figure 4:
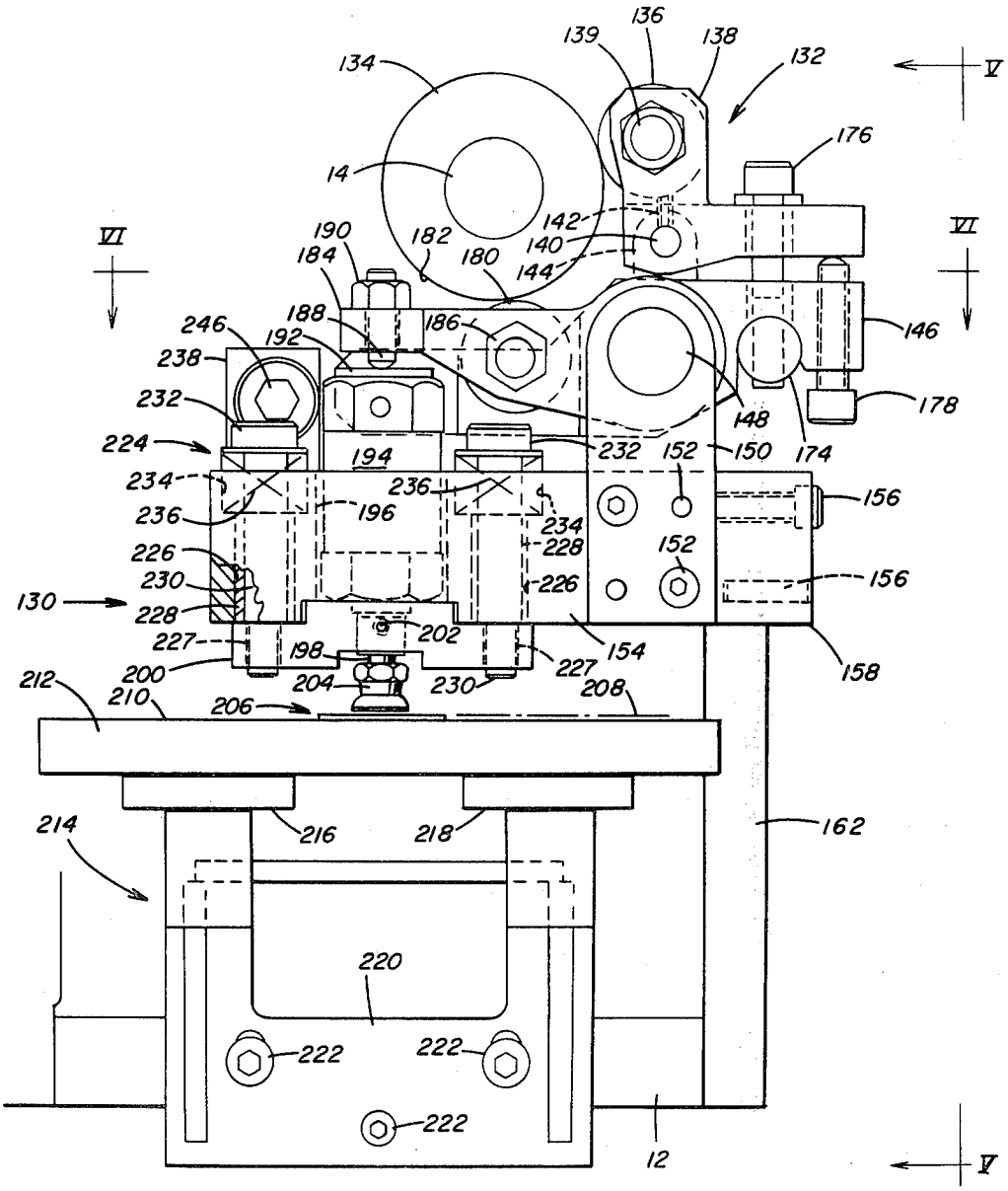
FIG. 4 is a fragmentary end view of the apparatus for synchronously moving the feed and idler rolls, which are not shown in FIG. 4, into and out of engagement with the workpiece and clamping of the workpiece when the feed roll is released.
Figure 5:
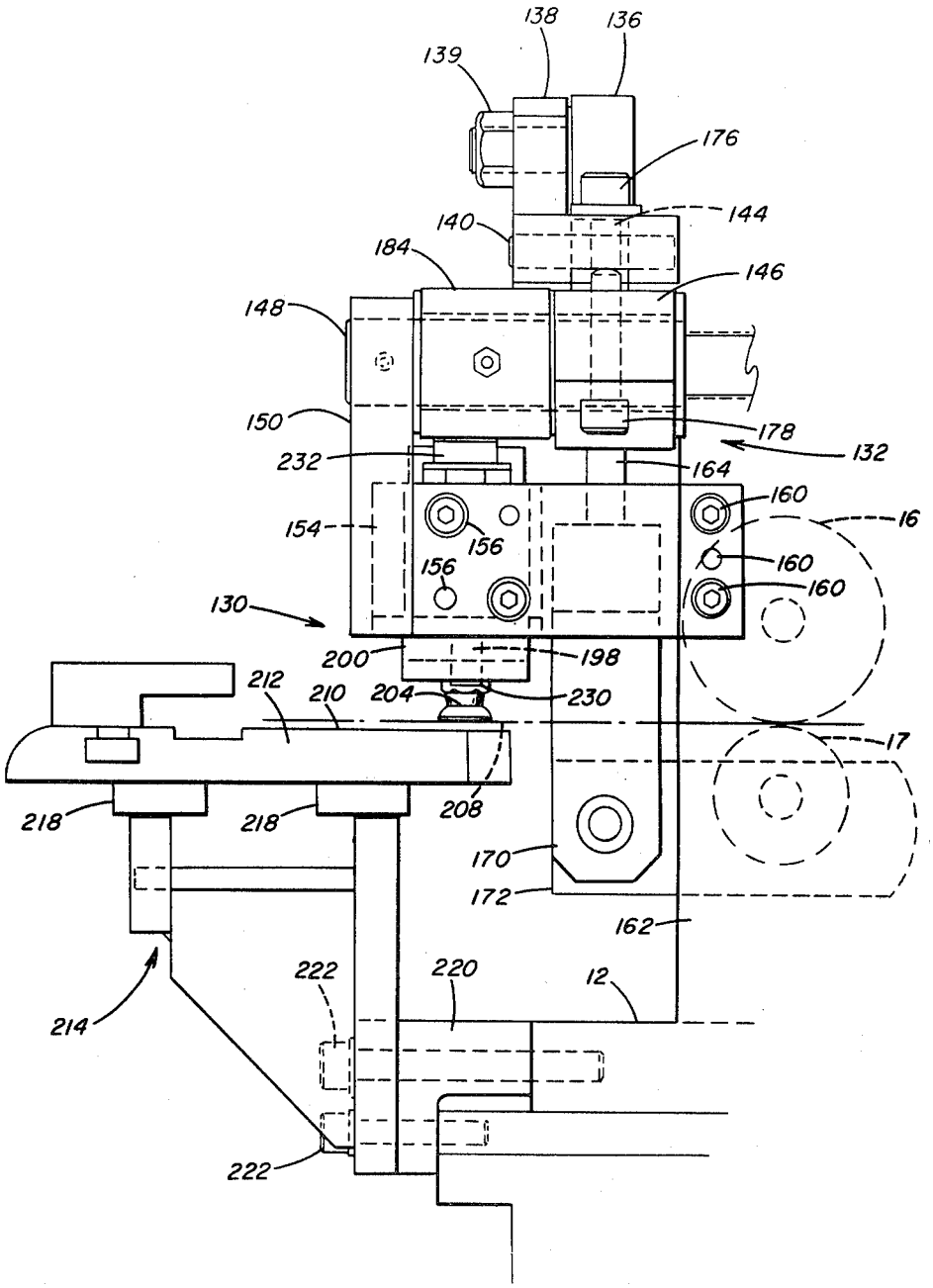
FIG. 5 is a fragmentary view in side elevation taken along line V—V of FIG. 4, illustrating the linkages for actuating the operations of feed roll release and stock material clamping.

In operation, for example during clockwise rotation of the driven feed roll 16 corresponding to the fixed angle of rotation of the output shaft 28, for example 60°, a preselected length of the stock material is fed by rotation of the driven feed roll 16. After completion of the angular movement of the driven feed roll 16 a first dwell period occurs during which time the driven feed roll 16 and the idler roll 17 are released from driving engagement with the stock material, and a clamping mechanism generally designated by the numeral 130 in FIGS. 4 and 5 is actuated to prevent movement of the stock material as the driven feed roll 16 is rotated back to the initial feed position. When the driven feed roll 16 has rotated counterclockwise through a selected angle of rotation, a second dwell period occurs during which time the clamping mechanism 130 is released from engagement with the stock material and the driven feed roll 16 and the idler roll 17 are moved back into driving engagement with the stock material for feeding another increment of stock material to the press.

Referring to FIGS. 4 and 5 there is illustrated the clamping mechanism 130, and a feed release mechanism generally designated by the numeral 132. The clmaping mechanism 130 is positioned adjacent to the driven feed roll 16 upstream of the feed roll 16 in the feed stock line. The clamping mechanism 130 and the feed release mechanism 132 are driven by a clamp release cam 134 and a roll release cam, positioned beyond cam 134 and not shown in FIG. 4, respectively.

The clamp release cam 134 and the roll release cam are also adjustably connected to rotate with the input shaft 14 that extends through the housing 12. The clamp release cam 134 and the roll release cam have a cam configuration that coordinates with the configuration of the feed cam 20, illustrated in FIG. 3, so that the feeding of the stock material is synchronized with the engagement of the rolls 16 and 17 with the stock material and release of the clamping mechanism 130 from engagement with the stock material.

By changing the respective angular positions of the clamp release cam and roll release cam on the input shaft 14 and then securing the cams in the selected position, it is possible to change the sequence of the clamp release and roll release operations to take place during the first dwell period or the second dwell period, respectively. By changing the sequence of the clamp release and the roll release operations it is possible to change the mterial feed direction to push the stock material into or pull the stock material away from the press. As stated above the cam 20 for controlling the feed of the stock material to the press is synchronized with the movement of the clamp release cam 134 and the roll release cam. Therefore, the operation of feeding the stock material can take place upon rotation of the cam plate 24 and output shaft 28 in either a clockwise direction or a counterclockwise direction. Accordingly the direction of rotation of the output shaft 28 to actuate feeding of the stock material to the press determines during which dwell periods the operations of clamp release and roll release take place.

The roll release cam is not shown but it should be understood it is similar to the clamp release cam 134 and includes a peripheral cam surface that supports a cam follower 136, as illustrated, connected to the end of a cam follower arm 138 by a nut and bolt combination 139. The cam arm 138 is pivotally mounted on a pivot pin 140 secured by a set screw 142 in the bore of a lug 144 that is connected to a lift arm 146. The lift arm 146 is pivotally mounted on one end of a shaft 148 that is retained in a bore of an upstanding support 150. The shaft 148 is connected at the opposite end to housing 12. The support 150 is secured by fasteners 152 to a mounting bracket 154. The mounting bracket 154 is, in turn, connected by fasteners 156 to a side rail 158 that is connected by fasteners 160 to a side plate 162 of housing 12.

Figure 6:
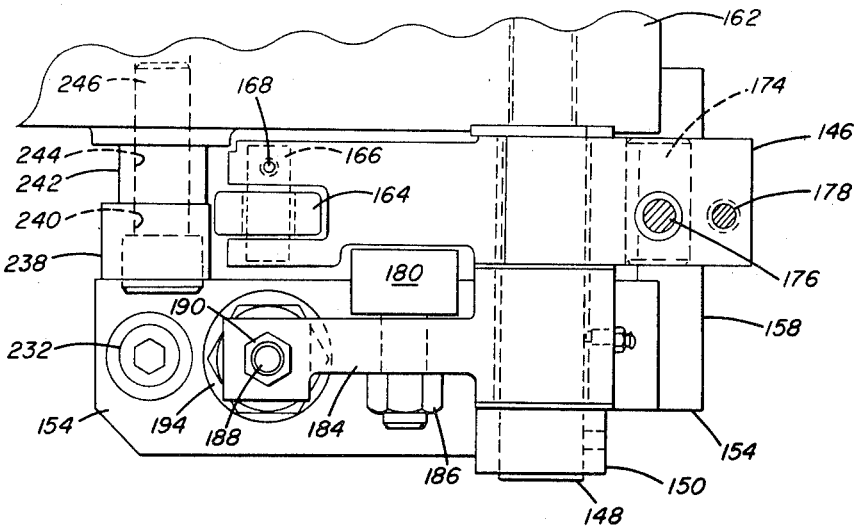
FIG. 6 is a plan view partially in section, taken along line VI—VI of FIG. 4, illustrating the arm members for actuating feed roll release and stock material clamping.

The lift arm 146, as illustrated in FIG. 6, is connected at one end to a roll release screw 164 by a lift pin 166 that extends through aligned bores of the lift arm 146 and the roll release screw 164. The lift pin 166 is retained by a set screw 168 in the aligned bores. As illustrated in FIG. 5, the lower end of the roll release screw 164 is connected to actuator arms 170. The actuator arms 170 are connected to a frame 172 that is supported for rotation within the housing 12. The details of rotatably supporting the frame 172 in the housing 12 are disclosed in the above referenced U.S. Pat. No. 3,977,589 and therefore will not be described in detail. The idler roll 17 is suitably journaled in the frame 172 so that upon rotation of the frame 172 by movement of the actuator arms 170, the idler roll 17 moves toward and away from the driven feed roll 16.

As illustrated in FIG. 4, on the opposite end of the lift arm 146 is mounted a pivot clamp screw 174 that is positioned in an annular recess of the lift arm 146. A cap screw 176 extends through the cam follower arm 138 and the lift arm 146 into threaded engagement with the pivot clamp screw 174 in order to adjustably clamp the arms 138 and 146. An adjusting screw 178 extends through the end of the lift arm 146 and abuts the end of the cam follower arm 138 to adjustably position the cam follower arm 138 and cam follower 136 relative to the surface of the roll release cam (not shown).

Thus in operation upon rotation of the roll release cam with the input shaft 14, the cam follower arm 138 is pivoted about pivot pin 148 by the action of the cam follower 136 on the surface of the roll release cam. The lift arm 146 pivots with the cam follower arm 138 to raise and lower roll release screw 164 and the actuator arms 170. During each cycle of the punch press the actuator arms 170 are actuated to raise the frame 172 and thereby rotate the frame 172 to lower the idler roll 17 away from the driven feed roll 16. This operation is disclosed in greater detail in the aboved referenced U.S. Pat. No. 3,977,589 which is assigned to the assignee of the present invention. Accordingly, the details of moving the frame 172 to raise and lower the idler roll 17 are beyond the scope of the present invention and are only schematically illustrated in FIG. 5.

When the idler roll 17 is lowered, the stock material is disengaged from the rolls 16 and 17 so that the stock material is not fed to the punch press during the punching operation. Furthermore during the interval where there is no material feed to the press, the driven feed roll 16 is rotated back to the initial position for the feed cycle. Accordingly, prior to the feed cycle the frame 172 is rotated to raise the idler roll 17 toward the drive feed roll 16 to return the rolls 16 and 17 to driving engagement with the stock material.

Synchronously with the movement of the roll release screw 164 and the actuator arms 170, illustrated in FIG. 5, to remove the rolls 16 and 17 from driving engagement with the stock material, rotation of the clamp release cam 134, illustrated in FIG. 4, is operable to actuate the clamping mechanism 130 to engage the stock material during the interval of angular rotation of the driven feed roll 16 back to the position for initiating the feed cycle. The clamping mechanism 130 is actuated by movement of the cam follower 180 on a cam surface 182 of the clamp release cam 134. The cam follower 180 is secured intermediate to a cam arm 184 by a nut and bolt combination 186. The cam arm 184 is pivotally mounted at one end portion on the shaft 148. The opposite end of the cam arm 184 is provided with an adjusting screw 188 that extends through and below the cam arm 184. The adjusting screw 188 is secured in a selected position on the cam arm 184 by a nut 190.

The lower end of the adjusting screw 188, as illustrated in FIG. 4, abuts the top surface of a pressure pad 192. The pressure pad 192 is suitably secured to an air actuated clamp cylinder 194. The clamp cylinder 194 is positioned for vertical movement in a bore 196 of the mounting bracket 154. The cylinder 194 includes an extensible cylinder rod 198 that extends below a clamp support 200 which reclines the lower end of clamp cylinder 194. The clamp support 200 is positioned for vertical movement below the mounting bracket 154. A set screw 202 extends through the clamp support 200 and into engagement with the lower end portion of the clamp cylinder 194. Thus the clamp cylinder 194 is connected to the clamp support 200. The cylinder rod 198 is connected by threaded engagement with a pad 204 arranged to move into and out of clamping engagement with the stock material generally designated by numeral 206 in FIG. 4. The feed line of the stock material is indicated by the numeral 208 as shown in FIGS. 4 and 5.

The stock material 206 is supported for longitudinal movement on the surface 210 of a guide plate 212, as illustrated in FIGS. 4 and 5. The guide plate 212 is horizontally supported by a frame generally designated by the numeral 214. The frame 214 includes pairs of support members 216 and 218 that are rigidly connected to the guide plate 212. The frame 214 is also provided with a base 220. The base 220 is connected by bolts 222 to the housing 12.

The pad 204 is shown in FIG. 4 in a raised position out of engagement with the stock material 206. In FIG. 5 the pad 204 is also shown in a raised position; however, the stock material is not shown in FIG. 5. When the pad 204 engages the stock material 206 the material is fixed to prevent feeding during the punching operation. Accordingly when the pad 204 is moved to the raised position the next increment of the stock material is fed to the punch press for the punching operation.

The pad 204 is lowered into clamping position by downward vertical movement of the clamp cylinder 194 in response to the pressure exerted on the pressure pad 192 by downward movement of the adjusting screw 188. The adjusting screw 188 moves downwardly by downward pivoting of the cam arm 184 on the shaft 148 as the cam follower 180 follows the cam surface 182 of the rotating clamp release cam 134. By the application of downward pressure upon the pressure pad 192, the clamp cylinder 194 and the clamp support 200 are moved downwardly relative to the fixed mounting bracket 154. The clamp cylinder 194 is connected by conventional means (not shown) to a source of air under pressure. In this manner the air pressure in the clamp cylinder 194 is regulated to maintain a constant pressure upon the cylinder rod 198 and normally position the rod 198 extended from the cylinder 194. Thus when the cylinder 194 is moved downwardly the rod 198 is fully extended from the cylinder 194. Downward movement of the cylinder 194 and extended rod 198 mvoes the pad 204 into clamping position with the stock material 206.

A spring return mechaism generally designated by the numeral 224 in FIG. 4 is provided to return the pad 204 to the raised position removed from engagement with the stock material 206 after the clamping cycle is completed upon continued rotation of the clamp release cam 134. This operation is synchronized with commencement of the feed cycle and movement of the rolls 16 and 17 into engagement with the stock material 206.

The spring return mechanism 224 includes a pair of bores 226 and 227 extending through the mounting bracket 154 and the clamp support 200 respectively. A bushing 228 is positioned in each bore of the mounting bracket 154. A bolt 230 extends through the respective bushing 228 and into threaded engagement with the clamp support 200. The bolts 230 are each provided with an enlarged head 232, and each bore 226 is provided with an enlarged diameter upper end portion 234 below the respective bolt head 232. Selected coil springs 236 are positioned in bore upper end portions 234 surrounding the bolts 230 and abut at one end the bolt heads 232 and at the opposite end the mounting bracket 154 surrounding the bore upper end portions 234. Thus the bolts 230 are positioned for vertical reciprocal movement in the bushing 228 of the mounting bracket 154.

With this arrangement, upon release of pressure upon the clamp cylinder 194 by upward pivoting of the cam arm 184, the clamp cylinder 194 moves upwardly within the bore 196 of the mounting bracket 154. The coil springs 236, being compressed by the downward movement of the bolts 230 with the clamp support 200 and the clamp cylinder 194 relative to the fixed mounting bracket 154, are free to extend and thereby raise the bolts 230 together with the clamp support 200 when the downward pressure upon the clamp cylinder 194 is relieved. The clamp support 200 moves upward with the bolts 230 upon extension of the coil springs 236. In this manner the extended cylinder rod 198 is raised with the clamp cylinder 194 to remove the pad 204 from clamping engagement with the stock material 206. This permits unimpeded movement of the stock material on the guide plate surface 210 during the feed cycle of the punch press.

The bolts 230 are vertically movable in the bushings 228 of the mounting bracket 154 which remains stationary. The clamp support 200 is movable relative to the mounting bracket 154. As illustrated in FIGS. 4 and 6, the mounting bracket 154 is provided with an upstanding arm 238 having a bore 240 therethrough. A spacer 242 is positioned between the upstanding arm 238 and the housing 12. The spacer 242 includes a bore 244 which is aligned with the bore 240. The aligned bores 240 and 244 receive a bolt 246 which extends into threaded engagement with housing 12 to further rigidly secure the mounting bracket 154 in a stationary position.

During the period of roll release, the clamp release cam 134 is operative to pivot the cam arm 184 downwardly on the shaft 148 so that the adjusting screw 188 applied a downward force upon the clamp cylinder 194. The cylinder 914 moves downwardly within the bore 196 of the mounting bracket 154 and compresses the coil springs 236. As described above, the cylinder rod 198 is maintained extended from the cylinder 194 by supplying the cylinder 194 with air at a preselected pressure. The air pressure is directed upon the upper end of the cylinder rod 198. When the cylinder 194 and the rod 198 move downwardly, the pad 204 is moved into clamping engagement with the stock material 206. During the clamping engagement of the stock material the air in the clamp cylinder 194 is further compressed to assure that the pad 204 exerts a preselected pressure upon the stock material 206 to prevent it from moving on the guide plate surface 210. Thus the stock material 206 is not advanced backwardly during the cycle when the feed roll 16 is returned to its initial position for the feed cycle.

Once the driven feed roll 16 has been rotated to its initial position for commencing the feed cycle, the cam arm 184 is pivoted upward to the position illustrated in FIG. 4. The coil springs 236 extend to raise the bolts 230, the clamp support 200, the cylinder 194, the cylinder rod 198, and the pad 204. The stock material is then free to move beneath the pad 204 on the surface 210 of the guide plate 212. Thus, it will be apparent with the present ivention that the operations of releasing the driven feed roll 16 and the idler roll 17 from engagement with the stock material and clamping the stock material are coordinated with the oscillating rotational movement of the output shaft 28 by the cam feed mechaism 18 as required to carry out the intermittent feeding of the stock material through the press.

Further in accordance with the present invention illustrated in FIG. 1, the enlarged gear 90 is mounted on the shaft 92 in a manner to facilitate the movement of the enlarged gear 90 relative to the reduced gear 124 shown in FIG. 2 and thereby permit adjustments in the meshing engagement of the gear teeth of gears 90 and 124. The gear shaft 92 includes an elongated body portion 248 upon which the enlarged gear 90 is positioned and a stub end portion 250 which is positioned in a bore 252 of the housing 12. Intermediate the shaft body portion 248 and the shaft end portion 250 is provided an enlarged diameter portion 254. The axes of the enlarged diameter portion 254 and the shaft body portion 248 are concentric; while, the axis of the stub end portion 250 is eccentric relative to the axes of shaft portions 248 and 254.

The shaft stub end portion 250 is held within th ebore 252 by the clamp ring 96 engaging the enlarged diameter portion 254 and the cap screw 94 threaded tightly into engagement with the clamp ring 96 and the housing 12. When the stub end portion 250 is clamped in position by the clamp ring 96, the stub end portion 250 is nonrotatably retained in the bore 252 of the housing 12. However, by loosening the cap screw 94, the entire shaft 92 and the shaft stub end 250 can be rotated.

Because of the eccentric relationship between the shaft portions 248 and 250, rotation of the shaft 92 permits the enlarged gear 90 to be moved laterally relative to the reduced gear 124 of the driven feed roll 16. This allows the gear teeth of the enlarged gear 90 to be removed into and out of precise engagement with the gear teeth of the reduced gear 124. Thus any backlash existing between the meshing gears 90 and 124 can be removed by first loosening the clamp ring 96 to permit rotation of the shaft 92 until the respective meshing gear teeth are engaged in a manner free of backlash. The gears 90 and 124 are then maintained in the desired meshing position by securely clamping the clamp ring 96 into engagement with the shaft enlarged diameter portion 254 by tightening of the cap screw 94.

By removing blacklash and play between the meshing gears 90 and 124 lost motion is removed in the transmission of rotation from the linkage mechanism 42. It will be apparent that this arrangement is particularly advantageous in permitting adjustments in the position of the enlarged gear 90 in order to compensate for machining tolerances that may exist between various enlarged gears 90 used to replace an existing gear 90 in the gear train for transmitting rotation from the output shaft 28 to the driven feed roll 16

The ability to adjust the position of the enlarged gear 90 obviates the need for precise machining of the drive gears so that tolerances may be permitted within the range of adjustment that can be made. This avoids the need for using expensively manufactured gear trains to assume that no lost motion exists in the transmission of rotation from the linkage mechanism 42 to the driven feed roll 16. Thus with the present invention the gear train provides for transmission of rotation free of lost motion between rotation of the output shaft 28 and the driven feed roll 16.

A further feature of the present invention is illustrated in FIG. 7 where the linkage mechanism 42 is connected directly to the driven feed roll 16. This arrangement is an alternative to the arrangement shown in FIGS. 1 and 2 for transmitting rotation from the linkage mechaism 42 through a gear train of two or more gears to the driven feed roll 16. The feed length for the embodiment of FIG. 7 is also adjusted by moving the slide block 46 on the transfer arm 44 by rotation of the adjusting screw 50 in the manner described above.

The linkage mechanism 42 in FIG. 7 includes a drive link generally designated by the numeral 256 having a first link portion 258 connected to the slide block bifurcated end portion 70 in a manner similar to the connection of drive link 48 to the end portion 70 shown in FIG. 2. The first link portion 258 is adjustably connected to a second link portion 260 by a threaded connector 262. The second link portion 260 is, in turn, connected to a secondary link 264 by a suitable connector 266 extending through aligned bores in the second link portion 260 and the secondary link 264. The secondary link 264 is connected to the shaft 128 of the driven feed roll 16 in a manner to transmit the oscillatory movement of the drive link 256 to the driven feed roll 16.

In this manner the driven feed roll 16 is rotated as above described for generating intermittent feeding of the stock material to the press. With the arrangement of FIG. 7, however, the oscillating rotational movement of the driven feed roll 16 is accomplished without the provision of the gear train shown in FIG. 1. Further, to provide for the direct linkage connection from the output shaft 28 to the driven feed roll 16, the transfer arm 44 is angularly displaced on the output shaft end portion 36 to a preselected position as shown in FIG. 7, to permit the slide block end portion 70 to be directly connected to the driven feed roll 16 by the drive link 256 and the secondary link 264.

Now referring to FIGS. 8–11, there is illustrated a second embodiment of the apparatus 10 for intermittently feeding a work piece, such as a sheet material, to a press for stamping, forming, or the like. It should be understood that many of the features of the second embodiment of the present invention illustrated in FIGS. 8–11 correspond to the similar features illustrated in FIGS. 1–7 and discussed above in detail.

Figure 9:
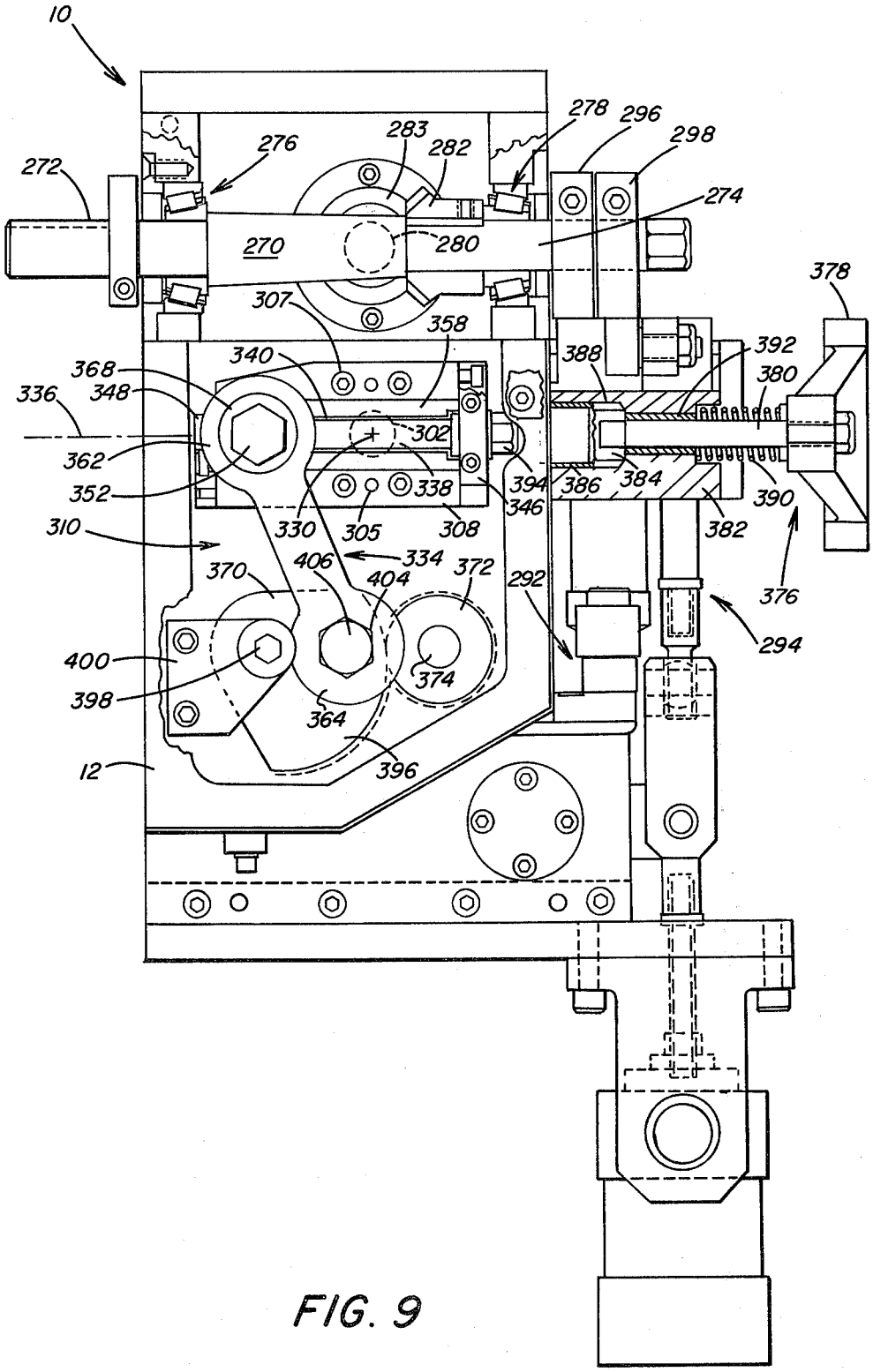
FIG. 9 is a view taken along line IX—IX of FIG. 8, illustrating the drive connection to the input shaft and a handwheel for turning the adjusting screw that controls the position of the drive link on the transfer arm.

In the second embodiment of the present invention as illustrated in FIG. 9, a first powered input shaft 270 is rotatably supported at its opposite end portions 272 and 274 by conventional bearing assemblies generally designated by the numerals 276 and 278, respectively. The first powered input shaft 270 is continuously rotared at a preselected speed by a suitable drive connection on the end portion 272 in a manner similar to that discussed for the input shaft 14 described above and illustrated in FIGS. 1 and 3. A second powered input shaft 280, which is illustrated in dotted lines in FIG. 9 and in full in FIG. 8, is positioned at a right angle with respect to the first powered input shaft 270.

The first powered input shaft 270 is drivingly connected to the second powered input shaft 280 by a pair of meshing gears 282 and 283, shown in FIG. 9. Gear 282 is nonrotatably connected to the intermediate portion of the first input shaft 270, and gear 283 is norotatably connected to a first end portion 284 of the second input shaft 280. The second powered input shaft 280 is also rotatably supported in the machine housing 12 by conventional bearing assemblies generally designated by the numerals 286 and 288. The second input shaft 280 includes a second end portion 290 that extends from the rear of the housing 12.

It should also be understood that the second embodiment of the intermittent feed apparatus 10 also includes a material clamping mechanism generally designated by the numeral 292 and a feed release mechaism generally designated by the numeral 294. The respective mechanism 292 and 294 correspond to the clamping mechanism 130 and the feed release mechanism 132 illustrated in FIGS. 4 and 5 of the first embodiment and discussed hereinabove in detail. The clamping mechanism 292 and the feed release mechanism 294, therefore, operate in substantially the same manner to produce substantially the same result as above described for the clamping mechanism 130 and the feed release mechanism 132.

The clamping mechanism 292 and the feed release mechanism 294 are driven by a clamp release cam 296 and a roll release cam 298, illustrated in FIG. 9. The clamp release cam 296 and the roll release cam 298 are adjustably, nonrotatably connected to the first powered input shaft 270 as illustrated in FIG. 9. The operations of the cams 296 and 298 to synchronously feed the stock material with the engagement of the rolls 16 and 17 with the stock material and release of the clamping mechanism 292 from engagemet with the stock material is carried out in the manner as above described for the clamping mechanism 130 and the feed release mechanism 132. Therefore, these operations will not be discussed in greater detail for the second embodiment of the intermittent feed apparatus 10.

The second power input shaft 280 is continuously rotated at a preselected speed, and the continuous rotation of the second input shaft 280 is converted by a cam drive mechanism generally designated by the numeral 300 to oscillating rotational movement of an output shaft 302 which corresponds to the output shaft 28 illustrated in FIG. 1 and above described for the first embodiment of the apparatus 10. The output shaft 302 is positioned in spaced parallel relation to the second input shaft 280 and is rotatably supported in the housing 12 at its end portions by conventional bearing assemblies generally designated by the numerals 304 and 306.

The output shaft 302 includes an enlarged end portion 303 which is nonrotatably connected by a plurality of dowel pins 305 and cap screws 307 to a transfer arm 308 of a linkage assembly generally designated by the numeral 310. The linkage assembly 310, as above described for the linkage assembly 42 in FIG. 1, is operable to transmit the oscillating movement of the output shaft 302 to the driven feed roll 16, which is also illustrated in FIG. 8 and corresponds to the driven feed roll 16 illustrated in FIG. 1.

Figure 11:
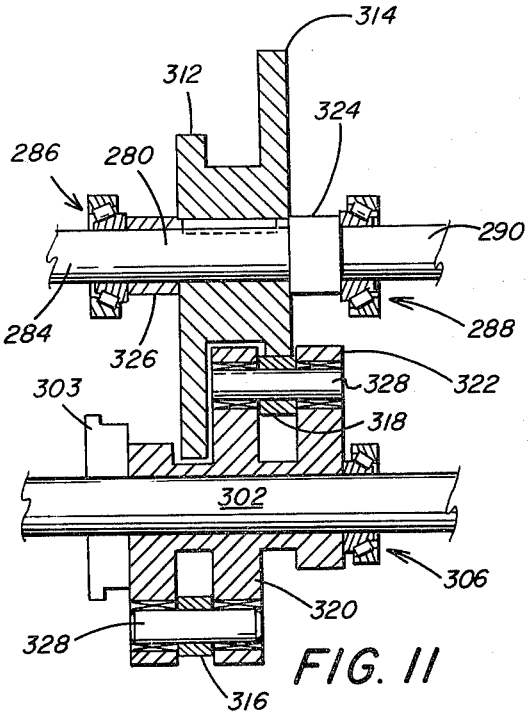
FIG. 11 is a sectional view taken along line XI—XI of FIG. 10.
Figure 10:
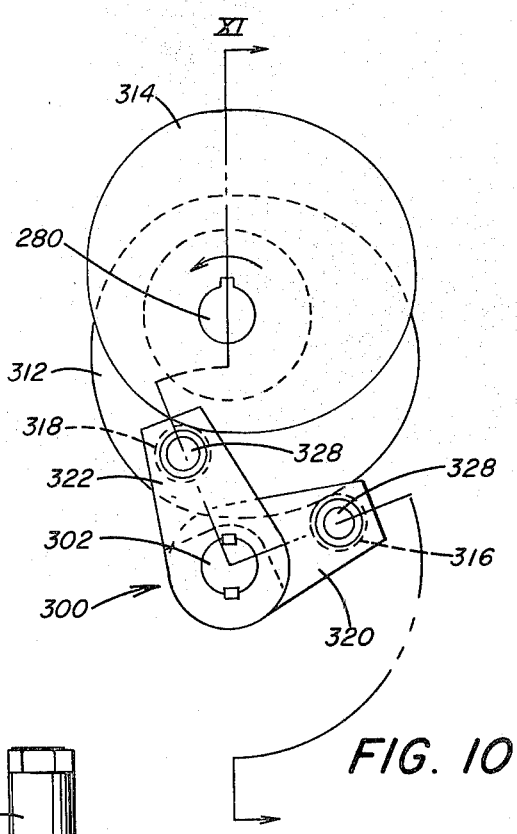
FIG. 10 is a fragmentary view in side elevation of the cam and cam follower arrangement for transmitting oscillatory motion to the output shaft of the cam feed shown in FIG. 8.

The cam drive mechanism 300 illustrated in FIGS. 8 and 10 and 11 includes a pair of radial conjugate cams 312 and 314 that are preloaded against a pair of cam followers 316 and 318 that are rotatably mounted on a pair of yoke members 320 and 322, respectively. The cams 312 and 314 have a preselected configuration to convert the continuous rotation of the second input shaft 280 to oscillating rotational movement of the output shaft 302. The cams 312 and 314 are nonrotatably connected to the intermittent portion of the second input shaft 280 and are maintained in a fixed axial position thereon by a shaft collar 324 and a cam spacer 326. Each of the cam followers 316 and 318 is mounted on a pin 328 which is rotatably retained in the respective yoke members 320 and 322 to permit rotation of the cam followers 316 and 318 as the cam followers 316 and 318 move on the peripheral surfaces of the cams 312 and 314.

As illustrated in FIG. 10, the yoke membes 320 and 322 maintain the cam followers 316 and 318 in contact with the peripheral surfaces of the cams 312 and 314. Each of the cams 312 and 314 has a corresponding configuration to generate oscillating rotational movement of the yoke members 320 and 322 and as a result, oscillate the output shaft 302 through a preselected angle of rotation. As for example as above described for the embodiment illustrated in FIG. 1, as the cam followers 316 and 318 follow the surface of the cams 312 and 314 during one revolution of the input shaft 280, the yoke membes 320 and 322 rotate from an initial position through a preselected angle, as for example an angle of 60°.

The yoke members 320 and 322 and the output shaft 302 stop during a first dwell period of rotation of the cams 312 and 314 and then resume rotation in the opposite direction through a corresponding angle, as for example an angle of 60°. The yoke members 320 and 322 and the output shaft 302 return to their initial starting position and are stopped during a second dwell period of rotation of the cams 312 and 314. By providing a pair of cams 312 and 314 the inertia of the moving stock material generated by acceleration of the stock material from an initial rest position to a maximum feed rate and then decelerating the stock material from the maximum feed rate to the rest position is compensated to maintain constant contact between the cams 312 and 314 and the cam followers 316 and 318. This arrangement assures zero backlash during each rotational cycle.

As above described for the cam plate 24 shown in FIG. 1, the yoke members 320 and 322 and the output shaft 302 oscillate from an initial position through a preselected angle and then back through the same angle to the initial position upon each revolution of the cams 312 and 314. Thus as the cams 312 and 314 continuously rotate, the cam followers 316 and 318 together with the yoke members 320 and 322 and the output shaft 302 oscillate back and forth through a preselected angle. At the end of each angle of rotation the yoke members 320 and 322 experience a dwell period in which the yoke members 320 and 322 do not move.

The oscillating movement of the output shaft 302 is transmitted by the linkage assembly 310 to the driven feed roll 16. As illustrated in FIGS. 8 and 9, the transfer arm 308 of the linkage assembly 310 overlies the axis of rotation 330 of the output shaft 302. The transfer arm 308 slidably supports a slide block 332 that is connected to one end of a drive link generally designated by the numeral 334. As illustrated in FIG. 9, the transfer 308 arm supports the slide block 332 for slidable movement along an axis 336 of an adjusting screw 338. The axis 336 of the adjusting screw 338 is transversely aligned with the axis of rotation 330 of the output shaft 302.

The transfer arm 308 has a longitudinally extending recessed portion 340 aligned with the adjusting screw axis 336. The slide block 332 is longitudinally movable in the recessed portion 340. The recessed portion 340 includes a radial groove 342 for receiving the adjusting scrw 338. Positioned opposite the radial groove 342 is a threaded radial groove 344 in the slide block 332 for threadedly receiving the adjusting screw 338. As seen in FIG. 9, the adjusting screw 338 is rotatably supported at its end portions in bearing blocks 346 and 348 which are secured to the transfer arm 308. With this arrangement, the adjusting screw 338 is rotatable relative to the transfer arm 308 but is restrained from axial movement relative to the transfer arm 308. Upon rotation of the adjusting screw 338 in a preselected direction, the slide block 332 moves longitudinally in the recessed portion 340 to a preselected position on the transfer arm 308.

A shaft 350 having a threaded end 352 is formed integral with the slide block 332 and extends outwardly therefrom. A clamp bushing 354 is positioned on the shaft 350. The clamp bushing 354 includes a plate end portion 356 that is slidable in a longitudinally extending recessed portion 358 of the transfer arm 308. The recessed portion 358 is positioned parallel to the recessed portion 340 on the slide block 332 where the recessed portion 358 extends the length of the recessed portion 340. A shaft portion 360 extends from the plate end portion 356, and the slide block shaft 350 extends through a bore of the shaft portion 360.

The drive link 334 includes a first end portion 362 and a second end portion 364. The first end portion 362 has a bore therethrough in which is positioned a bushing 366. The bushing 366 is positioned on the shaft portion 360. The drive link first end portion 362 is retained on the shaft portion 360 by a nut 368 that threadedly engages the shaft threaded end 352. The nut 368 tightly engages the threaded end 352 to urge the clamp bushing 354 into frictional engagement with the transfer arm 308 to thereby retain the slide block 332 in a preselected position on the transfer arm 308 relative to the point of intersection of adjusting screw axis 336 and the rotational axis 330 of the output shaft 302.

As illustrated in FIGS. 8 and 9, the drive link second end portion 364 is connected through a pair of meshing gears 370 and 372 to a shaft 374 of the driven feed roll 16. However, it should be understood that the drive link 334 can be directly connected to the driven feed roll 16 in an arrangement as illustrated in FIG. 7 and described above. With the arrangement in FIG. 9, the meshing gears 370 and 372 transmit oscillating movement of the drive link 334 to the driven feed roll 16. By connecting the drive link 334 to the shaft 374 of the driven feed roll 16 either directly or through meshing gears, the oscillating rotational movement of the output shaft 302 is transmitted to the driven feed roll 16 to thereby rotate the driven feed roll 16 through a preselected angle corresponding to a preselected length of the workpiece to be fed to a press.

The length of travel of the drive link 334 generated by the oscillating rotational movement of the output shaft 302 is adjustable, as above discussed, to provide a preselected degree of rotation of the driven feed roll 16 corresponding to a preselected feed length, as a result of the fixed angular rotation of the output shaft 302. The length of travel of the drive link 334 and accordingly the degree of rotation of the driven feed roll 16 and the resultant feed length increases with an increase in the distance between the connection of the drive link first end portion 362 on the transfer arm 308 and the rotational axis 330 of the output shaft, as illustrated in FIG. 9.

In FIG. 9, the drive link first end portion 362 is connected to the transfer arm 308 in a position substantially spaced from the rotational axis 330 to provide substantially a maximum feed length. Accordingly, to reduce the feed length, the drive link first end portion 362 is moved on the transfer arm 308 to a position closer to the rotational axis 330. In this manner, the feed length of the stock material to the press is substantially, infinitely adjustable and is accomplished by rotation in a preselected direction of the adjusting screw 338.

To make adjustments in the feed length, the nut 368 is loosened on the shaft threaded end 352 to thereby remove the clamp bushing plate end portion 356 from frictional engagement with the surface of the transfer arm 308 in the recessed portion 358. The adjusting screw 338 is then rotated in a preselected direction on the transfer arm 308 by a spring loaded actuating device generally designated by the numeral 376 in FIG. 9. The actuating device 376 includes a hand wheel 378 nonrotatably connected to the end of a shaft 380 that is positioned for rotational and axial movement in a block 382 that is secured to the housing 12.

A socket 384 is connected to the opposite end of the shaft 380 and is movable longitudinally through a bushing 386 positioned within a bore 388 that extends through the end of the block 382. The socket 384 is normally maintained in spaced axial relation opposite the head of the adjusting screw 338 of the transfer arm 308 by a compression spring 390. The spring 390 abuts at one end against a bearing sleeve 392 through which the shaft 380 extends in the block 382 and at an opposite end against the hand wheel 378 that is axially fixed on the opposite end of the shaft 380.

In operation, the length of travel of the drive link 334 is adjusted by adjusting the position of the drive link end portion 362 on the transfer arm 308. The adjusting screw 338 is rotated by the actuating device 376 to adjust the position of the drive link end portion 362 on the transfer arm 308. This is accomplished by nonrotatably connecting the socket 384 with the end portion 394 of the adjusting screw 338. By exerting an axial force upon the hand wheel 378, the spring 390 is compressed between the hand wheel 378 and the bearing sleeve 392. This advances the shaft 380 axially through the block 382 to a final position where the adjusting screw end portion 394 is positioned within the socket 384.

By engaging the flats of the socket 384 with the flats of the adjusting screw end portion 394, rotation of the hand wheel 378 in a preselected direction is transmitted to the adjusting screw 338. The slide block 332 together with the drive link end portion 362 are thus moved laterally to a preselected position on the transfer arm 308 with respect to the rotational axis 330 of the output shaft 302. Once the slide block 332 and the drive end portion 362 have been moved to a preselected position on the transfer arm 308 corresponding to a preselected feed length, the nut 368 is tightened on the threaded end 352.

The plate end portion 356 of the clamping bushing 354 is returned to frictional engagement with the transfer arm 308 to retain the drive link end portion 362 in the selected position on the transfer arm 308. This arrangement provides a very precise and easily obtained adjustment in the feed length of the driven feed roll 16. The adjustment is quickly accomplished avoiding downtime of the machine and eliminates the need for maintaining a large inventory of gears which is required for adjusting the feed length of the known material feed apparatus.

As further illustrated in FIGS. 8 and 9, the drive link second end portion 364 is eccentrically connected adjacent to the periphery of the gear 370, which is illustrated in FIG. 9 as a gear segment having gear teeth only on a radial segment 396 which is arranged to mesh with the teeth of the gear 372. However, it should be understood that the gear to which the drive link 334 is connected may have gear teeth around its entire periphery. It should also be understood that the drive connection of the drive link 334 to the driven feed roll 16 may include a plurality of meshing gears, for example a set of four meshing gears as opposed to a pair of meshing gears as in FIG. 9.

The gear segment 370 is rotatably positioned on a gear shaft 398 by a bearing assembly 399. The gear shaft 398 is rotatably supported at one end by a bracket 400 that is rigidly secured to the housing 12 and at the opposite end to the housing 12. As seen in FIG. 9, the point of connection of the drive link second end portion 364 is horizontally aligned with the axes of rotation of the gear shaft 398 and the feed roll shaft end portion 374 which supports the other gear 372. The drive link second end portion 364 is, in turn, connected eccentrically to the periphery of the gear segment 370 by a pin 402. The drive link end portion 364 abuts the top surface of the gear segment 370 and is maintained in a fixed axial position thereon by threaded engagement of a nut 404 with a threaded end 406 of the pin 402. The pin 402 includes an opposite enlarged end portion 408 that engages the under surface of gear segment 370. The gear segment 370 meshes with the gear 372 that is nonrotatably connected to the shaft 374 of the driven feed roll 16.

The gear segment 370 is mounted in a similar manner as above discussed for enlarged gear 90, shown in FIG. 1, to facilitate the movement of the gear 370 relative to the gear 372 to permit adjustments in the meshing engagement of the gear teeth of gears 370 and 372. The gear shaft 398 on which the gear segment 370 to rotatably positioned includes an eccentric end portion 410, illustrated in FIG. 8. The eccentric end portion 410 is positioned within a bore 412 of housing 12 and is retained therein by a clamp ring 414. The clamp ring 414 engages an enlarged diameter portion 416 of the gear shaft 398. A pair of screws 418 engage the clamp ring 414 to the housing 12. When the shaft eccentric end portion 410 is clamped in position by the clamp ring 414, the eccentric end portion 410 is nonrotatably retained in the bore 412 of the housing 12. However, by loosening the screws 418, the entire shaft 398 can be rotated.

As explained above with regard to the shaft 248 having the eccentric end portion 250 illustrated in FIG. 1, rotation of the shaft 398 permits the gear segment 370 to be moved laterally relative to the gear 372 of the driven feed roll 16. This allows the gear teeth of the gear segment 370 to be moved into and out of precise engagement with the gear teeth of the gear 372. Thus any backlash existing between the meshing gears 370 and 372 can be removed by first loosening the clamp ring 414 to permit rotation of the shaft 398 until the respective meshing gear teeth are engaged in a manner free of backlash. The gears 370 and 372 are then maintained in the desired meshing position by securely clamping the clamp ring 414 into engagement with the shaft enlarged diameter portion 416 by tightening the screws 418. By removing backlash and play between the meshing gears 370 and 372 lost motion is removed in the transmission of rotation from the linkage assembly 310 to the driven feed roll 16.

As illustrated in FIG. 8, the gear 372 that rotates the shaft 374 of the driven feed roll 16 is drivingly connected to the gear segment 370. However, as illustrated in FIG. 9, it should be understood that the axis of rotation of the shaft 374 is positioned in the same horizontal plane and parallel to the axis of the pin 402 that connects the drive link 334 to the gear segment 370. For purposes of clarity of illustration, in FIG. 8 the shaft 374 is shown displaced from its coplanar relationship with the pin 402 in order to more clearly illustrate the transmission of rotation from the input shaft 280 to the output shaft 302 through the linkage assembly 310 to the driven feed roll 16. Therefore, in FIG. 8 the shaft 374 and the driven feed roll 16 are shown in a position lowered from the FIG. 9 position in the housing 12.

The shaft 374 is rotatably mounted at its opposite end portions by a pair of bearing assemblies generally designated by the numerals 420 and 421 in the housing 12. The bearing assemblies 420 and 421 are retained in a preselected axial position on the shaft 374 by combination bearing nuts 422 and bearing washers 424. A mounting ring 426 and an adapter 428 are secured to the housing 12 and retain the bearing assembly 421 in place on the end of the shaft 374 opposite the end of the shaft 374 that carries the gear 372. Thus with the above described arrangement for the embodiment of the present invention illustrated in FIGS. 8 and 9, the angular movement of the driven feed roll 16 is adjustable by adjusting the position of the slide block 332 on the transfer arm 308 to, in turn, adjust the length of travel of the drive link 334 and change the feed length.

Figure 12:
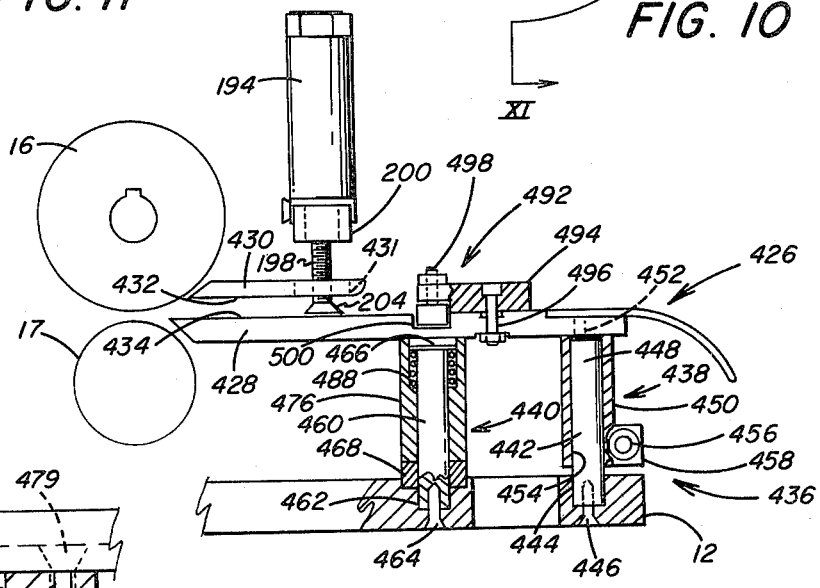
FIG. 12 is a partial sectional fragmentary view in side elevation of an adjustable material guide assembly, schematically illustrating the driven feed roll and the idler roll positioned adjacent the clamp cylinder.
Figure 13:
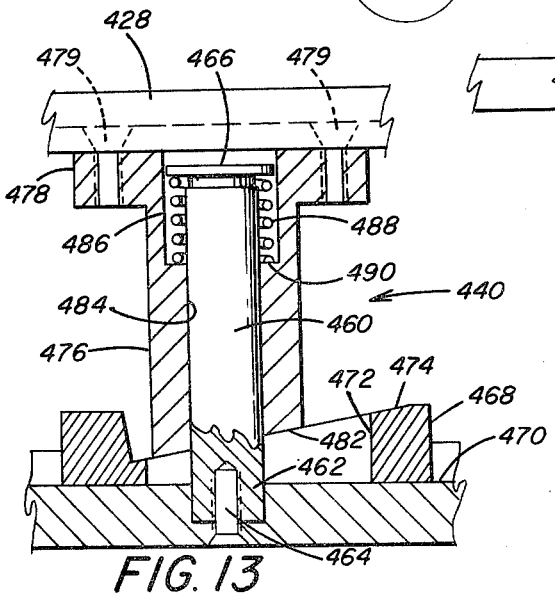
FIG. 13 is a schematic view in elevation of the adjusting mechanism for adjusting the elevation of the top plate of the material guide shown in FIG. 12.

Now referring to FIGS. 12 and 13, there is illustrated an adjustable material guide assembly generally designated by the numeral 426 for controlling the feeding of the stock material between the driven feed roll 16 and the idler roll 17. The material guide assembly 426 is mounted on the housing 12 between the feed roll 16 and the source of stock material (not shown) that is fed by the feed roll 16 into the press. The stock material, for example, may include a continuous reel of strip material having a preselected width and thickness and which is to be selectively shaped and cut from the continuous web of the stock material in peselected lengths or rewound after forming onto a continuous reel. Also in accordance with the present invention, the clamp cylinder 194 is secured on the housing 12 by the clamp support 200 in overlying relation to the material guide assembly 426.

As illustrated in FIG. 12, the material guide assembly 426 includes a movable material guide 428 and a stationary material guide 430. Preferably, the movable material guide 428 is a plate member which is horizontally supported relative to the housing 12 for movement in a vertical plane toward and away from the stationary material guide 430. The stationary material guide is also peferably a plate member which is rigidly secured by means (not shown), such as by bolting to the housing or machine frame 12. The stationary material guide 430 includes a bore 431 through which the rod 198 of the clamp cylinder 194 extends. The pad 204 secured to the rod 198 is vertically movable relative to the guide 430 into and out of clamping engagement with the stock material. The pad 204 is shown in a clamped position in FIG. 12.

The stationary material guide 430 has a lower surface 432 which is positioned oppositely and in parallel relation with an upper surface 434 of the movable material guide 428. The oppositely positioned surfaces 432 and 434 are normally spaced a preselected vertical distance apart to control and guide the movement of the stock material from the source to the feed roll 16 and the idler roll 17. The stock material is freely movable between the overlying oppositely positioned surfaces 432 and 434, and as the material is pulled, as for example, from a reel and fed in accordance with the present invention intermittently by the driven feed roll 16 to the press.

The portion of the stock material advancing on the movable material guide 428 toward the feed roll 16 is maintained along a substantially linear feed path. The material guide assembly 426 prevents deflection of the stock material from a linear feed path to a sine curve feed path. In accordance with the present invention, the relative position of the movable material guide 428 to the stationary material guide 430 is adjustable to accommodate a wide range of stock material thicknesses.

A support mechanism generally designated by the numeral 436 is mounted on the machine frame 12 and supports the movable material guide 428 for movement to a preselected position spaced oppositely from the stationary material guide 430. The support mechanism 436 is adjustable to provide a preselected spacing of the movable material guide 430 from the stationary material guide 428 so that the feed of stock material of a preselected thickness is maintained along a substantially linear path and is prevented from deflecting vertically from the feed path.

The support mechanism 436 includes a clamp device generally designated by the numeral 438 and an adjustment device generally designated by the numeral 440. The clamp device 438 is operable to secure the movable material guide 428 in a preselected position relative to the stationary material guide 430 for feeding of a preselected thickness of the stock material between the oppositely positioned surfaces 432 and 434 along a substantially linear feed path. The adjustment device 440 supports the movable material guide 428 on the machine 12 for movement toward and away from the stationary material guide 430. In this manner the vertical distance between the guides 428 and 430 is either increased or decreased. The distance separating the plates 428 and 430 is thus adjustable to accommodate a wide range of stock material thicknesses.

As illustrated in FIG. 12, the clamp device 438 includes a post 442 that extends between the machine frame 12 and the movable material guide 428. The post 442 includes a first end portion 444 seated in the frame 12 and secured thereto by a screw 446. A second end portion 448 of the post 442 is removed from contact with the lower surface of the movable material guide 428. A clamp 450 surrounds the post 442 and is secured to the lower surface of the movable material guide 428 by a pair of screws 452, only one of which is shown in FIG. 12. The clamp 450 includes a bore 454 in which the post 442 is positioned. The clamp 450 is a bifurcated member that is movable into and out of frictional engagement with the post 442.

When the clamp 450 is removed from frictional engagement with the post 442, the clamp 450 and the movable guide plate 428 are movable together as a unit relative to the fixed post 442 on the machine frame 12. Suitable means, such as a screw 456, extends through aligned threaded bores of a pair of bifurcated sections 458 (only one of which is shown in FIG. 12) of the clamp 450. By loosening the screw 456 to remove the clamp 450 from frictional engagement with the surface of the post 442, the clamp is movable to a preselected position on the post 442. Accordingly, moement of the clamp 450 relative to the fixed post 442 on the machine frame 12 moves the movable material guide 428 vertically toward or away from the stationary material guide 430. In this manner, the movable material guide 428 is maintained in a preselected position relative to the stationary material guide 430.

Tightening the screw 456 maintains the clamp 450 in a preselected position on the post 442 where the end of the post opposite the movable material guide 428 is maintained spaced from contact with the movable material guide 428. Thus, with the post 442 securely mounted to the machine frame 12 and the clamp 450 secured to the movable material guide 428, tightening of the screw 456 to prevent relative movement between the clamp 450 and the post 442 maintains the movable guide plate 428 at a preselected elevation above the machine frame 12 and spaced a preselected distance from the stationary material guide 430.

The adjustment device 440 for controlling the distance between the movable and stationary material guides 428 and 430 includes as illustrated in FIG. 12 and in greater detail in FIG. 13 a post 460 that extends between the machine frame 12 and the movable material guide 428. The post 460 includes a first end portion 462 seated in the machine frame 12 and secured thereto by a screw 464. An enlarged second end portion 466 is maintained removed from contact with the movable material guide 428.

An adjustment member 468, such as a slide block, is movable in a slot 470 of the machine frame 12. The slot 470 surrounds the post 460 and extends in a direction transversely to the direction of feed of the stock material. The adjustment member 468 includes an elliptical bore 472 through which the post 460 extends. The elongated nature of the bore 472 permits the adjustment member 468 to move transversely relative to the post 460 through a given range on the machine frame 12. The adjustment member 468 has a notched upper surface thereby forming an inclined surface 474.

The adjustment device 440 also includes a slide member 476 that coacts with the adjustment 468. The slide member 476 includes an enlarged upper end portion 478 that is suitably secured as by bolts 479 to the movable material guide 428 and includes a lower end portion 480 having an inclined surface 482 that slidably abuts the adjustment member inclined surface 474 in surrounding relation with the elliptical bore 472. The slide member 476 also has a bore 484 extending therethrough, and the bore 484 has an enlarged upper end portion 486 for receiving the enlarged second end portion 466 of the post 460.

With this arrangement, the slide member 476 is movable on the adjustment member inclined surface 474 upon release of the clamp 450 from frictional engagement with the post 442. The inclined surface 482 on the slide member 476 is complimentary with the oppositely positioned inclined surface 474 of the adjustment member 468. The slide member 476 is movable upwardly and downwardly on the adjustment member inclined surface 474 within a range permitted by the length of the slot 472 in the adjustment member 468.

As the adjustment member 468 moves, for example, to the left in FIG. 13 the slide member 476 advances up the inclined surface 474 to thereby raise the movable material guide 428 closer to the stationary material guide 430. Correspondingly, movement of the adjustment member 468 to the right advances the slide member 476 down the inclined surface 474 to lower the movable material guide 428 away from the stationary material guide 430. Thus, by moving the adjustment member 468 in the machine frame slot 470 in a preselected transverse direction the movable material guide 428 is moved either toward or away from the stationary material guide 430. In this manner, the spacing between the movable and stationary material guides 428 and 430 is adjusted to permit passage of stock material of a preselected thickness between the material guides 428 and 430 while preventing displacement of the stock material from the surface of the movable material guide 428.

When the selected spacing between the movable and stationary material guides 428 and 430 is obtained for a preselected thickness of the stock material, the clamp 450 is returned to frictional engagement with the post 442 by tightening the screw 456 through the bifurcated sections 458 of the clamp 450. In order to assure that the slide member 476 is retained in a preselected position on the inclined surface 474 of the adjustment member 468, a resilient device, such as a compression spring 488, is positioned within the enlarged diameter portion 486 of the slide member bore 484 in surrounding relation with the post 460.

The compression spring 488 abuts at one end portion the post enlarged second end portion 466 and at the opposite end a shoulder 490 of the slide member 476 positioned below the bore enlarged diameter portion 486. The compression spring 488, with the post 460 rigidly secured to the machine frame 12, normally exerts a downward force upon the shoulder 490 and upon the slide member 476 to urge the slide member inclined surface 482 into frictional engagement with the adjustment member inclined surface 474. This arrangement maintains the slide member 476 in a preselected position after an adjustment is made on the adjustment member 468 corresponding to a preselected thickness of the stock material for passage between the movable and stationary material guides 428 and 430.

With the above described arrangement of the material guide assembly 426 vertical deflection or sine-curve movement of the stock material to the driven feed roll 16 is prevented. In addition, a means generally designated by the numeral 492 is provided on the movable material guide 428 upstream of the stationary material guide 430 for preventing lateral deflection of the stock material in the plane of the feed path as stock material is fed along the movable material guide 428. The means 492 includes a pair of bars 494, only one of which is shown in FIG. 12, secured by bolts 496 in spaced parallel relation to the upper surface of the movable material guide 428.

The pair of bars 494 are laterally spaced a distance apart corresponding substantially to the width of the stock material fed to driven feed roll 16. Each of the bars 494 is movable laterally toward and away from each other to thereby decrease and increase the space through which the stock material passes. The bars 494 also include guide pins 498 that are movable in a transverse slot 500 extending across the movable material guide 428 to maintain the bars 494 in spaced, parallel alignment. Preferably each of the bars also includes a longitudinal slot (not shown) through which the lateral edge of the stock material is fed to further prevent lateral and vertical displacement of the stock material on the movable material guide 428 as the material is fed into engagement with the driven feed roll 16.

According to the provisions of the Patent Statutes, I have explained the principle, preferred construction and mode of operation of my invention and have illustrated and described what I now consider to represent its best embodiments. However, it should be understood, that within the scope of the appended claims, the invention may be practiced otherwise and as specifically illustrated and described.

I claim:

1. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selected direction, rotation transmission means drivingly connected at one to said output shaft second end portion and at another end to said feed means, said rotation transmission means being operable to transmit the oscillating rotational movement of said output shaft to said feed means and oscillate the feed means through a preselected angle of rotation, and said feed means being actuated by said oscillating rotational movement of said rotation transmission means to intermittently advance a preselected length of the workpiece corresponding to the angle of rotation of said feed means.

2. Apparatus for intermittently feeding a workpiece as set forth in claim 1 which includes, said rotation transmission means being arranged to travel through a preselected path corresponding to the oscillating rotational movement of said output shaft, and said rotation transmission means including a linkage for adjusting the connection of said output shaft to said feed means to provide a preselected length of travel of said linkage corresponding to a preselected length of the intermittent feed of the workpiece.

3. Apparatus for intermittently feeding a workpiece as set forth in claim 1 which includes, said output shaft having an axis of rotation, said output shaft being operable to oscillate about said axis of rotation through a preselected angle of rotation, said rotation transmission means including a linkage mechanism and an arm member, said arm member being connected to said output shaft, and said linkage mechanism being connected at one end to said feed means and at the opposite end to said arm member a preselected distance from said output shaft axis of rotation to provide a preselected feed length for the workpiece.

4. Apparatus for intermittently feeding a workpiece as set forth in claim 3 which includes, said linkage mechanism being adjustably connected to said arm member to effect a change in the length of the workpiece advanced upon oscillation of said output shaft in a preselected direction through a preselected angle of rotation.

5. Apparatus for intermittently feeding a workpiece as set forth in claim 1 which includes, said output shaft having an axis of rotation, adjusting means for adjustably connecting said rotation transmission means to said output shaft a preselected distance from said output shaft axis of rotation, and said rotation transmission means being movable on said adjusting means toward said axis of rotation to reduce the length of the intermittent feed of the workpiece and away from said axis of rotation to increase the length of the intermittent feed of the workpiece.

6. Apparatus for intermittently feeding a workpiece as set forth in claim 1 which includes, an arm member nonrotatably connected to said output shaft second end portion, said arm member having a longitudinally extending recess, said output shaft having an axis of rotation positioned perpendicular to said recess, a slide block positioned for longitudinal movement in said recess, an adjusting screw extending through said arm member and threadedly connected to said slide block, said adjusting screw being rotatably supported on said arm member and restrained from axial movement relative to said arm member such that upon rotation of said adjusting screw in a preselected direction said slide block moves longitudinally in said recess to a preselected position on said arm member, and said rotation transmission means being connected to said slide block to move with said slide block to a preselected position on said arm member spaced from said output shaft axis of rotation to generate a preselected angular displacement of said driven feed roll and a corresponding selected feed length of the workpiece.

7. Apparatus for intermittently feeding a workpiece as set forth in claim 6 in which, said rotation transmission means includes a drive link having a first end portion connected to said slide block and a second end portion drivingly connected to said feed means, means for frictionally engaging said drive link to said slide block to secure said drive link first end portion in a preselected position on said arm member, and said drive link being releasable from frictional engagement with said slide block to permit adjustments in the position of said slide block and said drive link first end portion on said arm member.

8. Apparatus for intermittently feeding a workpiece as set forth in claim 6 which includes, actuating means movable into and out of nonrotatable engagement with said adjusting screw for rotating said adjusting screw to move said slide block to a preselected position on said arm member.

9. Apparatus for intermittently feeding a workpiece as set forth in claim 8 in which said actuating means includes, a shaft positioned for longitudinal movement in spaced relation to said adjusting screw, said shaft having a first end portion with a socket secured thereto and a second end portion with a hand wheel secured thereto, resilient means acting on said shaft to normally maintain said socket in spaced relation from one end of said adjusting screw, and said socket being nonrotatably engagable with said adjusting screw upon compression of said resilient means so that rotation of said shaft upon turning said hand wheel is transmitted to said adjusting screw to selectively move said slide block.

10. Apparatus for intermittently feeding a workpiece as set forth in claim 1 in which, said cam drive means includes a cam follower nonrotatably connected to said first end portion of said output shaft, a cam nonrotatably connected to said input shaft to rotate continuously at a selected rate of rotation, means for maintaining said cam follower in contact with the surface of said cam so that rotation of said cam oscillates said cam follower to rotate through a preselected angleless than one complete revolution of said cam follower, and said cam follower being arranged to rotate in a first direction through a preselected angle, dwell, rotate in the opposite direction through said preselected angle, dwell, and commence rotation again in said first direction.

11. Apparatus for intermittently feeding a workpiece as set forth in claim 10 in which, said output shaft is positioned in right angle relation with said input shaft so that continuous rotation of said input shaft is converted to oscillating rotational movement of said output shaft by movement of said cam follower on said cam.

12. Apparatus for intermittently feeding a workpiece as set forth in claim 10 in which, said output shaft is positioned in parallel relation with said input shaft so that continuous rotation of said input shaft is converted to oscillating rotational movement of said output shaft by movement of said cam follower on said cam.

13. Apparatus for intermittently feeding a workpiece as set forth in claim 1 which includes, release means drivingly connected to said input shaft for intermittently releasing said feed means from feeding engagement with the workpiece, and said release means being operable to disengage said feed means from the workpiece following the intermittent advance of the workpiece while said feed means is rotated into position to commence a subsequent advance of a preselected length of the workpiece.

14. Apparatus for intermittently feeding a workpiece as set forth in claim 1 which includes, clamp means drivingly connected to said input shaft for engaging the workpiece to prevent movement of the workpiece between the intermittent feeding of the workpiece, and said clamp means being synchronously actuated with actuation of said feed means so that during the intervals said feed means is being oscillated into position for the subsequent feed cycle said clamp means engages the workpiece to prevent movement of the workpiece.

15. Apparatus for intermittently feeding a workpiece as set forth in claim 1 in which, said rotation transmission means includes a plurality of meshing gears for transmitting the oscillating rotational movement of said output shaft to said feed means, one of said plurality of meshing gears being drivingly connected to said output shaft second end portion, and another of said plurality of meshing gears being drivingly connected to said feed means.

16. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selection direction, a linkage drivingly connected at one end to said output shaft second end portion and at another end to said feed means, said linkage being operable to transmit the oscillating rotational movement of said output shaft to said feed means and oscillate the feed means through a preselected angle of rotation, and said feed means being actuated by said oscillating rotational movement of said linkage to intermittently advance a preselected length of the workpiece.

17. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selection direction, a gear train connected to said feed means for transmitting rotation to said feed means, a linkage drivingly connected at one end to said output shaft second end portion and at another end to said gear train, said linkage being operable to transmit the oscillating rotational movement of said output shaft to said gear train to oscillate the feed means through a preselected angle of rotation, and said feed means being actuated by said oscillating rotational movement of said gear train to intermittently advance a preselected length of the workpiece corresponding to the angle of rotation of said feed means.

18. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selection direction, a plurality of meshing gears for transmitting rotation to said feed means, a linkage drivingly connected at one end to said output shaft second end portion and at another end to said plurality of meshing gears, one of said plurality of meshing gears being drivingly connected to said linkage, another of said plurality of meshing gears being drivingly connected to said feed means, adjustment means for supporting said plurality of meshing gears in meshing relation to facilitate relative lateral movement of a selected one of said meashing gears to place said plurality of meshing gears in meashing relation free of relative movement between one another and thereby prevent lost motion in the transmission of rotation from said output shaft to said feed means, said linkage being operable to transmit the oscillating rotational movement of said output shaft to said plurality of meshing gears to oscillate the feed means through a preselected angle of rotation, and said feed means being actuated by said oscillating rotational movement of said plurality of meshing gears to intermittently advance a preselected length of the workpiece corresponding to the angle of rotation of said feed means.

19. Apparatus for intermittently feeding a workpiece as set forth in claim 18 which includes, a housing for rotatably supporting said plurality of meshing gears, clamp means being releasably engageable with said housing for maintaining said plurality of meshing gears in a meshing engagement free of relative movement between said plurality of meshing gears, and said clamp means being operable upon release from engagement with said housing to permit adjustments in the relative meshing relation of said plurality of meshing gears.

20. Apparatus for intermittently feeding a workpiece as set forth in claim 18 which includes, a shaft, said shaft having a first portion for rotatably supporting a selected gear of said plurality of meshing gears, said shaft having a second portion, a housing for supporting said shaft second portion, said shaft second portion being eccentrically positioned relative to said shaft first portion, and said shaft first portion being rotatable to move said selected gear laterally and thereby adjust the meshing relation of said selected gear with another one of said plurality of meshing gears to remove play between said plurality of meshing gears and assure complete transmission of rotation from said output shaft to said feed means.

21. Apparatus for intermittently feeding a workpiece comprising, an input shaft supported for rotation at a continuous preselected speed, an output shaft having a first end portion and a second end portion, cam drive means drivingly connecting said output shaft first end portion to said input shaft for generating oscillating rotational movement of said output shaft through a preselected angle of rotation, feed means for intermittently feeding a preselected length of the workpiece in a selection direction, a linkage drivingly connected at one end to said output shaft second end portion, a pair of meshing gears for transmitting oscillating rotational movement of said output shaft through said linkage to said feed means, one of said pair of meshing gears being drivingly connected to said linkage and the other of said pair of meshing gears being drivingly connected to said feed means, means for changing the location of the point of meshing engagement of one of said pair of meshing gears with said other of said pair of meshing gears to prevent accelerated wear of the portions of said pair of gears positioned in meshing relation, said linkage being operable to transmit the oscillating rotational movement of said output shaft to said pair of meshing gears and oscillate said pair of meshing gears through a preselected angle of rotation, and said feed means being actuated by said oscillating rotational movement of said pair of meshing gears to intermittently advance a preselected length of the workpiece corresponding to the angle of rotation of said feed means.

22. Apparatus for intermittently clamping a workpiece comprising, an input shaft supported for rotation at a continuous preselected speed, a linkage pivotally mounted at a first end relative to said input shaft, cam means nonrotatably connected to said input shaft for generating oscillating pivotal movement of said linkage, clamp means for intermittently engaging the workpiece to prevent movement of the workpiece, cylinder means having a rod extending from one end of said cylinder means, said clamp means being connected to said rod, support means for supporting said cylinder means for upward and downward reciprocal movement, said linkage being positioned in abutting relation at a second end to said cylinder means, said linkage being intermittently pivoted upwardly and downwardly upon rotation of said cam means to reciprocate said cylinder means upwardly and downwardly on said support means, and said clamp means being intermittently movable into and out of clamping engagement with the workpiece upon movement of said cylinder means.

23. A material guide assembly for controlling the feeding of stock material comprising, a machine frame, a movable material guide movably positioned on said machine frame, a stationary material guide supported by said machine frame and fixed relative to said movable material guide, said stationary material guide being spaced oppositely of said movable material guide to permit feeding of the stock material between said movable and fixed material guides, support means mounted on said machine frame for supporting said movable material guide for movement to a preselected position spaced oppositely from said stationary material guide, and said support means being adjustable to provide a preselected spacing of said movable material guide from said stationary material guide so that the feed of stock material of a preselected thickness is maintained along a substantially linear path.

24. A material guide assembly as set forth in claim 23 which includes, means secured to said movable material guide for preventing lateral deflection of the stock material in the plane of the feed path as the stock material is fed between said movable and stationary material guides.

25. A material guide assembly as set forth in claim 24 in which, said means for preventing lateral deflection of the stock material includes a pair of bars secured in spaced parallel relation to said movable material guide and extending along the feed path of the stock material, and said bars being laterally spaced a distance apart corresponding substantially to the width of the stock material to prevent lateral movement of the stock material from the selected feed path as the stock material is fed between said movable and stationary material guides.

26. A material guide assembly as set forth in claim 23 which includes, feed means for feeding the stock material in a selected direction, said feed means being rotatably supported in said machine frame closely adjacent said movable and stationary material guides, and said movable and stationary material guides being positioned in the feed path upstream of said feed means and operable to prevent vertical deflection of the stock material from a linear feed path as the stock material is introduced into said feed means.

27. A material guide assembly as set forth in claim 23 in which said support means includes, clamp means for securing said movable material guide in a preselected position relative to said stationary material guide to permit a preselected thickness of the stock material to pass between said movable and stationary material guides while maintaining the stock material in a substantially linear feed path, and adjustment means for supporting said movable material guide on said machine frame for movement toward and away from said stationary material guide to decrease and increase the spacing between said movable and stationary material guides in accordance with the thickness of the stock material.

28. A material guide assembly as set forth in claim 27 in which said clamp means includes, a post extending between said machine frame and said movable material guide, said post including a first end portion secured to said machine frame and a second end portion removed from contact with said movable material guide, a clamp surrounding said post and secured to said movable material guide, said movable material guide and said clamp being movable together as a unit relative to said post on said machine frame, and means for urging said clamp into and out of clamping engagement with said post to permit movement of said clamp to a preselected position on said post for maintaining said movable material guide in preselected spaced relation from said stationary material guide.

29. A material guide assembly as set forth in claim 27 in which said adjustment means includes, a post extending between said machine frame and said movable material guide, said post including a first end portion secured to said machine frame and an enlarged second end portion removed from contact with said movable material guide, an adjustment member positioned on said machine frame in surrounding relation with said post, said adjustment member being movable relative to said post on said machine frame, said adjustment member having an inclined surface, a slide member secured at one end to said movable material guide and having at the opposite end an inclined surface slidably abutting said adjustment member inclined surface, said slide member having a bore therethrough for receiving said post, and said slide member being movable on said adjustment member inclined surface upon release of said clamp means to permit movement of said movable material guide toward and away from said stationary material guide to adjust the spacing between said movable and stationary material guides for passage of a preselected thickness of the stock material therebetween.

30. A material guide assembly as set forth in claim 29 which includes, resilient means positioned on said post adjacent said enlarged second end portion thereof for exerting a force upon said slide member to maintain said slide member in a preselected position on said adjustment member inclined surface corresponding to a preselected thickness of the stock material for passage between said movable and stationary material guides.

* * * * *